US012241249B2

(12) United States Patent
Brisson

(10) Patent No.: US 12,241,249 B2
(45) Date of Patent: Mar. 4, 2025

(54) BUILDING ASSEMBLY

(71) Applicant: Dale Brisson, Delray Beach, FL (US)

(72) Inventor: Dale Brisson, Delray Beach, FL (US)

( * ) Notice: Subject to any disclaimer, the term of this patent is extended or adjusted under 35 U.S.C. 154(b) by 730 days.

(21) Appl. No.: 17/551,033

(22) Filed: Dec. 14, 2021

(65) Prior Publication Data

US 2023/0183977 A1 Jun. 15, 2023

(51) Int. Cl.

| | |
|---|---|
| ***E04B 1/61*** | (2006.01) |
| ***E04B 2/64*** | (2006.01) |
| ***E04B 7/02*** | (2006.01) |
| ***E04C 2/20*** | (2006.01) |
| ***E04C 3/28*** | (2006.01) |
| ***E04C 3/36*** | (2006.01) |

(52) U.S. Cl.

CPC ..... *E04C 3/36* (2013.01); *E04B 1/6116* (2013.01); *E04B 2/64* (2013.01); *E04B 7/022* (2013.01); *E04C 2/205* (2013.01); *E04C 3/28* (2013.01)

(58) Field of Classification Search

CPC . E04C 2/02; E04C 2/205; E04C 2/284; E04C 2003/0408; E04C 2003/0413; E04C 2003/043; E04C 3/124; E04C 3/20; E04C 3/34; E04C 3/36; E04C 3/44; E04B 1/61; E04B 1/6108; E04B 1/612; E04B 1/165; E04B 1/161

See application file for complete search history.

(56) References Cited

U.S. PATENT DOCUMENTS

| | | | | |
|---|---|---|---|---|
| 4,091,590 | A * | 5/1978 | Miura | E04B 2/28 52/591.5 |
| 5,050,358 | A * | 9/1991 | Vladislavic | E04B 1/161 52/250 |
| 5,335,472 | A * | 8/1994 | Phillips | E04C 3/44 D25/138 |
| 5,992,102 | A * | 11/1999 | Ozawa | E04B 2/44 52/441 |
| 10,072,411 | B1 * | 9/2018 | Moran | E04B 2/7401 |
| 10,472,822 | B1 * | 11/2019 | Castro | E04C 1/40 |
| 2001/0003234 | A1 * | 6/2001 | Van Doren | E04B 1/165 52/250 |

* cited by examiner

*Primary Examiner* — Jessica L Laux

(57) ABSTRACT

A building assembly includes a plurality of expanded polystyrene wall panels, headers, sill panels, U blocks, U block caps, roof panels, and connectors. Each U block includes rebar and at least one of concrete and cementitious material in a recess or void therein. Each U block cap when joined to the U block creates an enclosed void in the U block which holds the rebar and concrete and/or cementitious material. A plurality of capped U blocks joins a plurality of wall panels, headers, and sills to form a wall structure. A plurality of U blocks are placed on a top surface of the wall structure. A roof assembly including a plurality of U blocks, H connectors, T connectors, and combinations thereof connected to roof panels to form a rigid roof assembly. A coating of cementitious material provides additional structural rigidity and resistance to impact, fire, water, mold, mildew, and insects.

20 Claims, 40 Drawing Sheets

60
20
18
22b
22a
21
18
22a
21c
18'
18f
22a
10
22a
18'
18f
22a
12
15
18f
18'
18f
21c
18f
21c
18'
22a
10
18
22a
18'
21c
10

BUILDING ASSEMBLY

FIELD OF THE INVENTION

The present invention relates to an efficient, swift, low cost, building assembly for prefabrication of exterior walls, interior walls, floors and roofs to form a building.

BACKGROUND

Many techniques have been utilized to reduce building costs associated with conventional building construction. Normally, conventional building construction involves a labor intensive process where skilled workers and laborers may pour a concrete foundation, assemble a walls and roof stud assembly made of wood or metal studs, individual blocks made of varying materials that are stacked on each other and clad with varying materials, attach exterior and interior walls, assemble roof panels, and set and install windows and doors. On many occasions, the construction of the building may involve numerous contractors and subcontractors who are responsible for various stages of construction. Typically, delays arise and construction costs escalate accordingly.

One of the existing techniques used to reduce construction costs involves the use of prefabricated modular type homes. Typically, modular homes involve the use of panels, which are shipped to a construction site and only require the connection of the prefabricated panels in order to construct the building. The use of prefabricated panels provides a less expensive and easily assembled building as opposed to the conventional construction methods. One drawback associated with modular buildings is that modular homes tend to lack sufficient strength and durability for long-term use. Modular homes also tend to lack the necessary flexibility to accommodate various sizes and styles. Furthermore, some modular systems require the inclusion of traditional construction techniques in order to complete construction, therefore, escalating the costs associated with modular homes.

Other prefabricated buildings and a corresponding methods includes a plurality of space tubular steel columns, a pair of tubular steel girds each interconnecting respective ends of the columns and the plurality of space tubular steel cross members arranged in pairs, connected on opposite sides of the columns in a registry with each other to accommodate various available building materials. These designs and methods address some of the strength and durability shortcomings in the prior art, however, the panels may still be costly to assemble and may be somewhat limited in use in regard to design and style.

Further, some building construction systems may comprise a modular, transportable construction kit-type structure, which includes vertical frame members that are used in conjunction with a plurality of corrugated material panels and a quantity of concrete. These building construction systems and methods require extensive labor, and therefore do not reduce costs sufficiently in order to provide a complete substitute for traditional construction methods.

Accordingly, a need exists for an improved prefabricated building assembly system to build permanent homes, which truly addresses the shortcomings of the prior art. More specifically, a prefabricated building assembly that allows for low cost building construction, flexibility to accommodate various designs, and sufficient re-enforcement capabilities to provide many years of use, and to provide a durable building capable of surviving hurricane force winds and earthquakes with no or minimal damage would be desirable.

SUMMARY OF THE INVENTION

In one embodiment of the invention, a building assembly to form a building includes a foundation. The foundation includes rebar positioned in preselected areas of the foundation and the rebar extends above the foundation in preselected areas. The building assembly also includes a plurality of building components, which includes a plurality of wall panels preformed from expanded polystyrene, a plurality of sill panels preformed from expanded polystyrene, a plurality of header panels preformed from expanded polystyrene, a plurality of U blocks preformed from expanded polystyrene. Each U block of the plurality of U blocks includes a recess preformed therein and extending therethrough. The plurality of U blocks are defined by a first portion of U blocks, a second portion of U blocks, and a third portion of U blocks. A preformed U block cap is configured to be positioned over the recess of each U block of the first portion and each U block of the third portion to cover the recess therein. The preformed U block cap is connected to each U block via an adhesive to form a void extending therethrough. The building assembly further includes a plurality of wall structures formed from a plurality of preselected formations connected together via the adhesive. Each pre-selected formation includes at least one preformed U block from the plurality of U blocks of the first portion, and at least one other building component of the plurality of building components selected from the group consisting of a) one preformed wall panel of the plurality of wall panels, b) one preformed sill panel of the plurality of sill panels, and c) one preformed header from the plurality of headers, to form each preselected formation. Each U block of the second portion is positioned in at least one of a horizontal position and an angled position on an upper surface of each preselected formation to form each wall structure of the plurality of wall structures. Each U block of the second portion is positioned with the recess therein positioned on an upper surface thereof. Each U block of the second portion is connected to each preselected formation via the adhesive. A plurality of openings are formed in the recess of each U block of the second portion, and a perimeter of each opening is axially aligned with a perimeter of the recess of each U block of the first portion in each wall structure, respectively. Each U block of the first portion of the plurality of U blocks includes rebar in the recess therein, and when each wall structure is positioned vertically on the foundation, the rebar in each U block of the first portion is connected to the rebar extending from the preselected locations of the foundation. Each U block of the second portion of the plurality of U blocks has rebar positioned in the recess therein, and the rebar in each U block of the first portion extends upward and connects to the rebar in the second portion. The rebar in each U block of the first portion connects to rebar positioned in each recess of each U block of a third portion of the plurality of U blocks on a roof structure constructed over at least a pair of wall structures. One U block cap is positioned over the recess of each U block of the first portion and adhesively connected to the U block of the first portion to form the void therein after rebar is inserted therein. At least one of concrete and cementitious material is positioned in the recess of each U block of the second portion and flows through the plurality of openings therein to the void of each capped U block of the first portion, such that the rebar and the at least one of concrete and cementitious material in each capped U block of the first portion forms a solid structural vertical column, and the rebar and the at least one of concrete and cementitious material in the recess of each U block of the second portion forms a wall bond beam for structural support. The building assembly further includes a preformed window perimeter structure included in at least one wall structure which includes the sill panel and the header panel. The sill panel and the header panel are positioned spaced apart between a pair of capped U blocks of the first portion of the plurality of U blocks to form the perimeter for a window opening configured to receive a window frame and a window. Each capped U block of the pair of capped U blocks of the first portion includes the void with rebar and the at least one of concrete and cementitious material positioned therein. Each capped U block includes a plurality of recesses positioned on a side of each capped U block. The plurality of recesses on the side are connected to the void and including the at least one of concrete and cementitious material therein. And the building assembly includes a preformed outer door perimeter included in at least one wall structure which includes a header panel positioned between a pair of capped U blocks of the first portion of the plurality of U blocks to form the perimeter for a door opening configured to receive a door frame and a door. Each capped U block of the pair of capped U blocks of the first portion includes the void with rebar and the least one of concrete and cementitious material positioned therein. Each capped U block includes a plurality of recesses positioned on a side of each capped U block, the plurality of recesses on the side connected to the void and including the at least one of concrete and cementitious material therein. Further, the building assembly includes the roof structure. The roof structure includes at least one pair of opposing end wall structures. Each end wall structure of the at least one pair including at least one end wall beam positioned above and connected via the adhesive to each of the pair of opposing end wall structures. The at least one end wall beam is formed from one or more U blocks of the second portion. Each U block has rebar and the at least one of concrete and cementitious material positioned in the recess therein. A roof apex beam extends between an apex of each end wall structure of the pair of end wall structures. A plurality of support brackets are connected to the roof apex beam and to at least one wall bond beam. The plurality of support brackets are positioned spaced-apart and opposite relative to each other on the roof apex beam and the at least one wall bond beam, respectively, to form a plurality of pairs of opposing support brackets, each opposing pair of support brackets carrying a support. Moreover, the building assembly includes a plurality of preformed roof panels formed from an expanded polystyrene. Each roof panel of the plurality of roof panels are connected to at least one of a) each other via the adhesive, b) at least one U block of the third portion of the plurality of U blocks, and c) at least one connector. Each roof panel is carried by at least one support of the roof structure and forms a roof panel structure when connected to at least one of a) a plurality of roof panels connected to each other and connectable to the roof structure, b) a U block of the third portion connectable to the roof structure, and c) at least one connector connectable to the roof structure. When each U block of the third portion of the plurality of U blocks is included in the roof panel structure, the recess in each U block of the third portion includes rebar and is configured to hold the at least one of concrete and cementitious material. The rebar in each U block of the third portion extends to connect to at least a portion of the roof structure. Each U block of the third portion has one preformed U block cap which is connected via the adhesive to cover the recess thereof in order to hold the at least one of concrete and cementitious material therein.

In another aspect of the one embodiment, the pair of capped U blocks of the first portion having the plurality of recesses forming a part of each preformed sill perimeter and a part of each preformed door perimeter, the at least one of concrete and cementitious material within the plurality of recesses provides rigidity and reinforcement to each preformed sill perimeter and each preformed door perimeter. In a further aspect, the plurality of recesses in the side of each capped U block are spaced-apart and perpendicular relative to the void in each capped U block.

In yet another aspect of the one embodiment, at least a portion of the plurality of roof panels includes a pair of grooves formed in side edges thereof and each roof panel interconnects with at least one other roof panel via an H connector which includes a plurality of legs which insert into the pair of grooves in each roof panel. Each H connector includes one or more holes to permit coupling of the H connector to at least one of a) the roof panel and b) the roof structure.

In still another aspect of the one embodiment, at least a portion of the plurality of preformed roof panels includes a groove formed in each side edge thereof and each roof panel interconnects with another roof panel via a T connector which includes a pair of legs. Each leg inserts into the groove in each roof panel, wherein each T connector includes one or more holes to permit coupling of the T connector to at least one of a) the roof panel and b) the roof structure.

Also, in another aspect of the one embodiment, the building assembly further comprises a cementitious material which is applied to the building constructed from the building assembly to encompass all surfaces of all inside structures and all outside structures of the building in the cementitious material. The cementitious material has a thickness in a range from one-eighth (⅛) inch thickness to one (1) inch thickness. In an additional aspect, the cementitious material forms a monocoque structure which encompasses the building, so that the building is rated to withstand hurricane force winds and the monocoque structure is resistant to earthquakes.

In yet another aspect of the one embodiment, the building assembly comprises a preformed interior partition wall structure formed from a portion of the plurality of wall panels. In a further aspect, the preformed interior partition wall structure includes an inner door perimeter which is formed from at least one wall panel and a header panel.

In still yet another aspect of the one embodiment, each U block having a U block cap has one of a square perimeter defining the void therein and a rectangular perimeter defining the void therein.

In another embodiment of the invention, a method of using a building assembly to construct a building includes providing a foundation having rebar positioned in preselected areas therein and extending thereabove. The method also includes providing a plurality of building components, including a plurality of preformed wall panels formed from expanded polystyrene, a plurality of sill panels formed from expanded polystyrene, a plurality of header panels formed from expanded polystyrene, a plurality of U blocks preformed from expanded polystyrene. Each U block of the plurality of U blocks includes a recess preformed therein and extending therethrough. The plurality of U blocks are defined by a first portion of U blocks, a second portion of U blocks, and a third portion of U blocks. A preformed U block cap is configured to be positioned over the recess of each U block of the first portion and each U block of the third portion to cover the recess. The preformed U block cap is connected to each U block via an adhesive to form a void extending therethrough. The method further includes forming a plurality of wall structures from a plurality of preselected formations, each of the preselected formations constructed by selecting at least one preformed U block of the first portion of the plurality of U blocks and at least one other building component of the plurality of building components selected from the group consisting of a) one preformed wall panel of the plurality of wall panels, b) one preformed sill panel of the plurality of sill panels, c) one preformed header panel of the plurality of header panels, connecting the selected building components together via the adhesive to form each preselected formation, and connecting each U block of the second portion of the plurality of U blocks to an upper surface of each preselected formation via an adhesive. Each U block of the second portion positioned in at least one of a horizontal position and an angled position to form each wall structure. A plurality of openings are formed in the recess of each U block of the second portion, and a perimeter of each opening is aligned with a perimeter of the recess of each U block of the first portion. The method further includes positioning rebar in each U block of the first portion of the plurality of U blocks. The method also includes positioning rebar in each U block of the second portion of the plurality of U blocks. And, the method includes connecting the rebar in one end of each U block of the first portion with rebar in preselected areas of the foundation, and connecting rebar in an opposite end of each U block of the first portion to rebar in each U block of the second portion, the rebar of each U block of the first portion configured to connect to rebar in each U block of the third portion of the plurality of U blocks also. The method includes positioning one U block cap over the recess of each U block of the first portion of the plurality of U blocks by connecting the U block cap via the adhesive to each U block of the first portion to form a plurality of capped U blocks of the first portion. The method also includes providing a preformed window perimeter included in one wall structure of the plurality of wall structures which includes a sill panel spaced apart from a header panel and positioning both the sill panel and the header panel between a pair of capped U blocks of the first portion to form a perimeter for a window opening configured to receive a window frame and a window. Each capped U block of the pair of capped U blocks includes the void with rebar therein as well as a plurality of recesses on a side of each capped U block of the pair of capped U blocks forming a portion of the perimeter, the plurality of recesses on the side connecting to the void in each capped U block and configured to receive at least one of concrete and cementitious material therein. The method further includes providing a preformed outer door perimeter included in one wall structure of the plurality of wall structures which includes a header panel positioned between a pair of capped U blocks of the first portion of the plurality of U blocks to form the perimeter for an outer door opening configured to receive an outer door frame and an outer door. Each capped U block of the pair of capped U blocks of the first portion includes a void therein as well as a plurality of recesses on a side of each capped U block of the pair of capped U blocks forming a portion of the perimeter, the plurality of recesses on the side connecting to the void in each capped U block and configured to receive the at least a portion of the at least one of concrete and cementitious material therein. And, the method includes providing the roof structure. The roof structure includes at least one pair of opposing end wall structures. Each end wall structure includes at least one end wall beam which is positioned above and connected via the adhesive to at least one wall structure of the plurality of wall structures. The at least one end wall beam is formed from one or more U blocks having rebar and the at least one of concrete or a cementitious material positioned in the recess therein. A roof apex beam extends from an apex of each end wall structure. Moreover, the method includes providing a plurality of support brackets connected to at least one of the roof apex beam and at least one wall bond beam. The method also includes connecting the plurality of support brackets in opposing pairs on the roof apex beam and the at least one wall bond beam, respectively. The method also includes providing a plurality of roof supports and positioning the plurality of roof supports, such that each opposing pair of support brackets carries one roof support of the plurality of roof supports. Further, the method includes providing a plurality of roof panels formed from expanded polystyrene. Each roof panel of the plurality of roof panels is connected to at least one of a) each other via the adhesive, b) one U block of the third portion, and c) at least one connector. Each roof panel is carried by at least one support of the roof structure and forms a plurality of roof panel structures when connected to at least one of a) a plurality of roof panels connect to each other and connectable to the roof structure, b) at least one U block of the third portion connectable to the roof structure, and c) at least one connector carrying a roof panel connectable to the roof structure. The method includes providing rebar to each U block of the third portion of the plurality of U blocks and connecting rebar extending from each U block of the first portion to one end of the rebar in each U block of the third portion, and connecting an opposite end of the rebar in the third portion to rebar in the roof structure. The method also includes pouring the at least one of the of the concrete and cementitious material into the recess of each U block of the third portion, and connecting one U block cap via adhesive to each U block of the third portion to close the recess and to form a void having rebar and the one of concrete and cementitious material. Further, the method includes simultaneously pouring the at least one of concrete and cementitious material into the recess of the second portion of the U blocks of the plurality of U blocks such that the at least one of concrete and cementitious material flows through and fills the recesses in each U block of the second portion. The at least one of the concrete and cementitious material flows through the plurality of openings formed in each recess of each U block of the second portion and into each void of each capped U block of the first portion to fill each void thereof. Each U block of the first portion forms a structural vertical column, each U block of the second portion forms a structural wall bond beam, and each U block of the third portion forming a structural beam of the roof structure.

In one aspect of the other embodiment, in the steps of providing a preformed sill perimeter, and providing a preformed door perimeter, the at least one of concrete and cementitious material is positioned in the void of each U block of the pair of U blocks of the first portion and in the plurality of recesses to fill the recesses to provide rigidity and reinforcement to each preformed sill perimeter and each preformed door perimeter. In this aspect, the plurality of recesses in the side of each capped U block are spaced-apart and perpendicular relative to the void in each capped U block.

In yet one aspect of the other embodiment, in the step of providing a plurality of roof panels, at least a portion of the plurality of roof panels includes a pair of grooves formed in side edges thereof and each roof panel interconnects with at least one other roof panel via an H connector which includes a plurality of legs which insert into the plurality of grooves in each roof panel. Each H connector includes one or more holes to permit coupling of the H connector to at least one of a) the roof panel and b) the roof structure.

In still another aspect of the other embodiment, in the step of providing a plurality of roof panels, at least a portion of the plurality of roof panels includes a groove formed in each side edge thereof and each roof panel interconnects with another roof panel via a T connector which includes a pair of legs. Each leg is inserted into the groove in each roof panel. Each T connector includes one or more holes to permit coupling of the T connector to at least one of a) the roof panel and b) the roof structure.

And in another aspect of the other embodiment, the embodiment further comprises the step of applying a cementitious material to a building constructed from the building assembly to encompass all surfaces of all inside structures and all outside structures of the building in the cementitious material, wherein the cementitious material has a thickness in a range from one eighth (⅛) inch thickness to one (1) inch thickness. In and additional aspect, the cementitious material forms a monocoque structure which encompasses the building, and the building is rated to withstand hurricane force winds and the building is resistant to earthquakes.

In another aspect of the other embodiment, the embodiment further comprises the step of providing a preformed interior partition wall structure formed from a portion of the plurality of preformed wall panels. Each wall panel of the plurality of walls panels is connected to each other via the adhesive.

In still yet another aspect of the other embodiment, wherein in the step of providing a plurality of U blocks, each U block having a U block cap has one of a square perimeter defining the void therein and a rectangular perimeter defining the void therein.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1A:
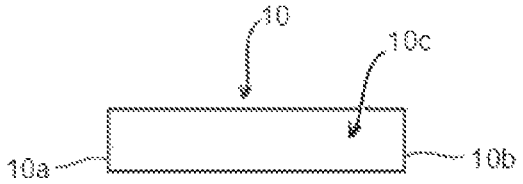
FIG. 1A is a top plan view of a wall panel according to the present invention.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. The variations of "comprising", "including" and "having", such as, but not by way of limitation, "comprise", "include", "have" or "has", are also included in this definition. Any examples of operating parameters and/or environmental conditions are not exclusive of other parameters/conditions of the disclosed embodiments.

The present invention relates to a prefabricated building assembly capable of providing a swift, efficient and economic construction of exterior load bearing walls, interior load bearing walls, interior partition walls, floors, and roofs to form a building assembly. The present invention includes lightweight prefabricated panels that desirably form a building assembly comprised of exterior walls, interior partition walls, bearing walls, floors and roofs. A building built from the present building assembly may be assembled in its entirety, or the wall and roof system may be utilized independently of each other and adapted to include standard building materials (i.e. standard roof trusses, standard interior framing, standard drywall, exterior block walls, and the like). The panels may be constructed primarily of expanded polystyrene components to build exterior walls, interior walls, bearing walls, and roof system for lightweight, high insulation benefits. The wall components may consist of U blocks, U block caps, headers, sills, and wall panels.

The prefabricated building components of the building assembly desirably include prefabricated panels shaped from an expanded polystyrene which, for example, may be from 4 to 6 inches thick, or alternatively 6 to 24 inches thick, 6 to 24 feet in length, and 1 to 24 feet in width, depending upon the job specifications and requirements. However, it will be understood that any length, width, height, and thickness of any building components herein may be molded, preformed and/or prefabricated to any building specification.

Some building components, for example, but not by way of limitation, are U blocks which may have U block caps attached thereto to form large voids which extend through the U block. U blocks are disposed vertically and others are disposed horizontally or at an angle to form structural columns and other structural supports. The voids of these U blocks desirably contain rebar and concrete and/or a cementitious material to provide structural stability and load bearing for a structure.

Other building components such as some panels, for example, but not by way of limitation, wall panels and roof panels, which do not themselves include rebar, concrete, or cementitious material, may also include voids and/or recess for utilities such as electrical wiring, plumbing, HVAC components, internet, and the like. These plurality of small passageways desirably may be preformed both horizontally and/or vertically.

An adhesive is also used to connect the various building components of the building assembly together into preselected formations, as will be described in detail below. Such adhesives include, but are not limited to, 3M™ Polystyrene Insulation Adhesive 78 or a low rise polyurethane foam adhesive such as DuPont ENERFOAM™ Adhesive. The cementitious material used herein may include, but not by way of limitation, RecoMix™ formulation, which is available from World Housing Holdings, LLC, a Wyoming LLC. Other cementitious materials are commercially available.

The building assembly, and desirably all inner and outer structures (with the possible exception of portions of the foundation), receive one or more applications of the cementitious material in a range from one-eighth (⅛) inch to one (1) inch thickness, to provide strength rigidity, and resistance to water, fire, insects, mold and mildew.

For additional structural strength, steel rebar in the foundation connects with rebar within voids of certain components, including U-blocks and capped U blocks. Concrete and/or cementitious material is desirably poured into these voids and recesses to combine with the rebar to provide increased structural stability to the building assembly.

One of the purposes of the present building assembly is to take advantage of the use of light-weight materials described herein which form the bulk of the construction. These materials are desirably custom prefabricated in a factory environment and then shipped to the building site for assembly and for the addition of limited finishes. This reduces shipping costs and manual labor costs. Building customized preselected formations to form wall structures and roof structures from the building components which include preformed wall panels, sill panels, header panels, U blocks, capped U blocks, roof panels, and connectors as described herein, result in a building that is rapidly and inexpensively built, significantly reducing labor costs for on-site construction.

Figure 1B:
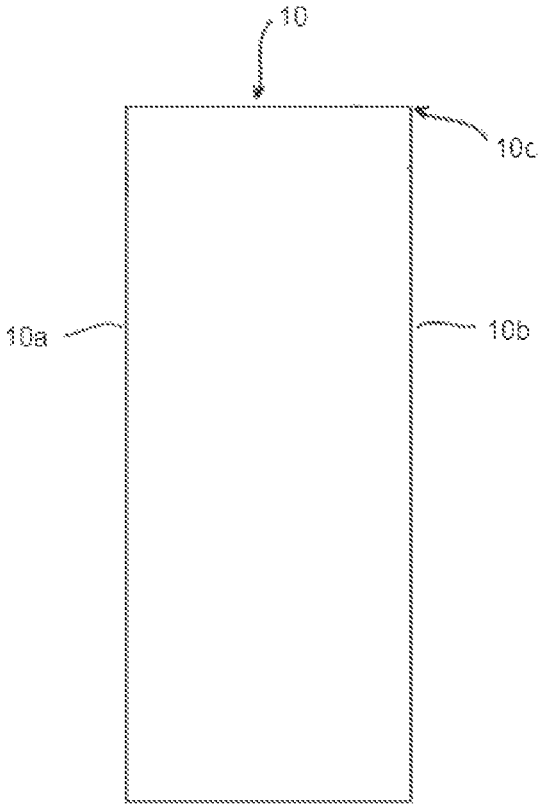
FIG. 1B is a front view of the wall panel of FIG. 1A.
Figure 1C:
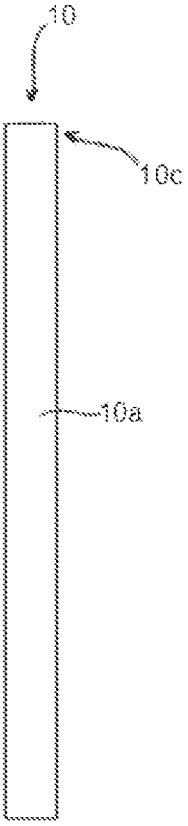
FIG. 1C is a side view of the wall panel of FIGS. 1A and 1B.
Figure 1D:
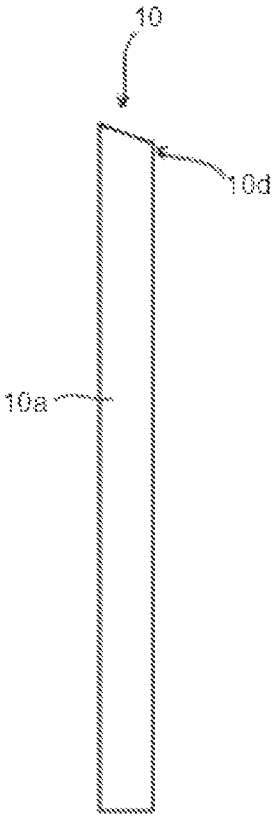
FIG. 1D is a side view of a wall panel like those of FIGS. 1A-1C, but having an angled upper edge.

To this end, FIG. 1A-1C illustrates a standard molded wall panel 10, in which FIG. 1A is a side elevational view showing two flat faced sides 10*a*, 10*b*, and a flat top (upper surface) 10*c*. A frontal elevational view and a side view of wall panel 10 are also illustrated in FIGS. 1B and 1C. However, FIG. 1D provides a side view of the wall panel 10 that contains an angled top 10*d*.

Figure 2A:
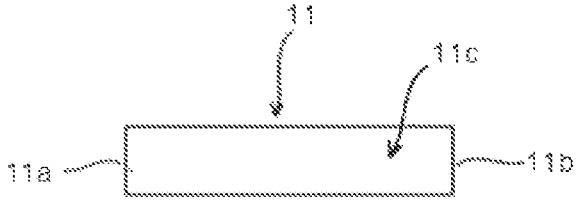
FIG. 2A is a top plan view of a gable wall panel according to another embodiment of the present invention.
Figure 2B:
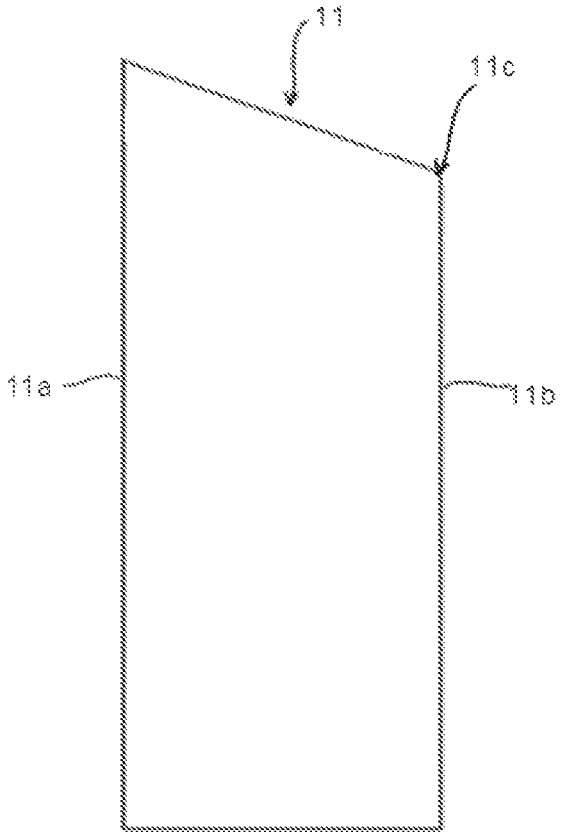
FIG. 2B is a front view of the gable wall panel of FIG. 2A.
Figure 2C:
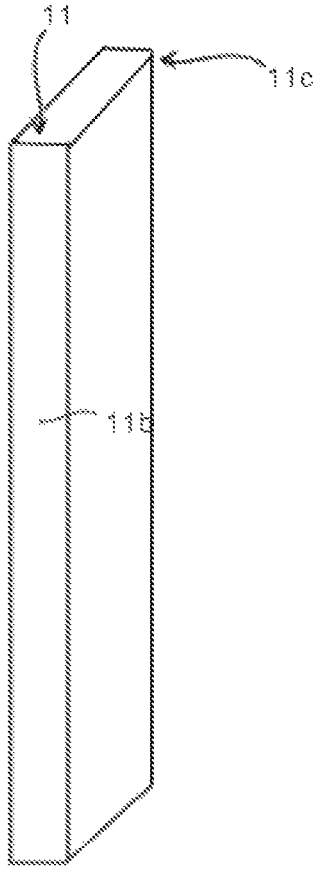
FIG. 2C is a perspective view of the wall panel of FIGS. 2A and 2B.
Figure 3A:
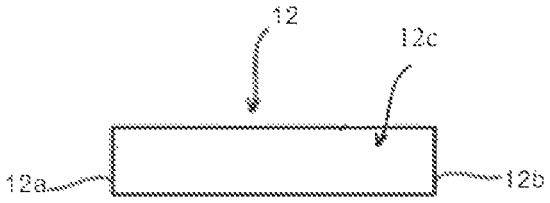
FIG. 3A is a top plan view of a sill panel according to the present invention.
Figure 3B:
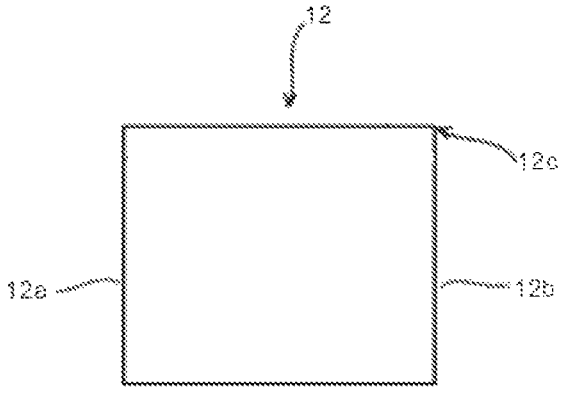
FIG. 3B is a front view of the sill panel of FIC. 3A.
Figure 3C:
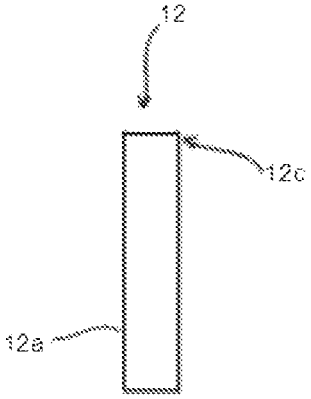
FIG. 3C is a side view illustrating an edge of the sill panel of FIGS. 3A and 3B.
Figure 4A:
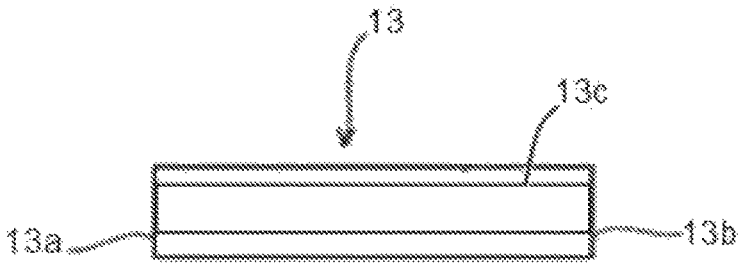
FIG. 4A is a top plan view of an alternative sill panel with recess according to another embodiment of the present invention.
Figure 4B:
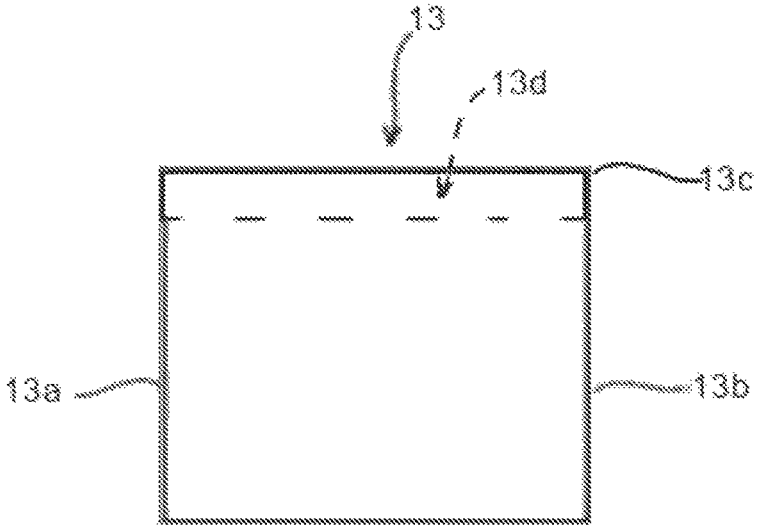
FIG. 4B is a front view of the sill panel of FIG. 4A, with phantom lines indicating the recess therein.
Figure 4C:
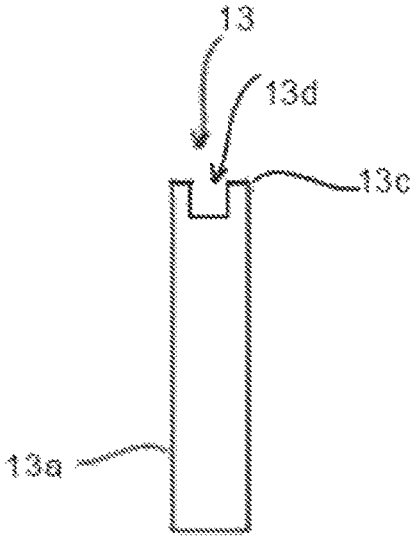
FIG. 4C is a side view of the sill panel of FIGS. 4A and 4B, illustrating the recess therein.

FIGS. 2A-2B shows a molded gable wall panel 11 in which FIGS. 2A, 2B, and 2C illustrates the gable wall panel having two flat faced sides 11*a*, 11*b* and an angled top 11*c*.

The wall panels 10, 11 may be sized differently in length, width, or thickness, to accommodate the specifications of a given building plan. As described below, in some instances, U block caps are joined to U blocks by the adhesive described herein, and U blocks are joined to each side of wall panels, sills, and headers via the adhesive, to form both exterior and interior load bearing walls. Interior walls (interior partition wall structures) also may include wall panels and headers, door openings, and the like, and are joined together and to the foundation or a floor, and a ceiling or a lower surface of a roof via the adhesive. However, it will be appreciated that non-load bearing interior walls may not require U blocks. The foundation may comprise a footer (FIG. 20A) in which rebar embedded to support each vertical U block. The foundation may comprise any material(s) known in the art to form a floor or a foundation.

Two types if molded sill panels 12 and 13 are illustrated in FIGS. 3A-3C and FIGS. 4A-4C, respectively. Four types of header panels, 14, 15, 16, 17 are illustrated in FIGS. 5A-5C, FIGS. 6A-6C, FIGS. 7A-7C, and FIGS. 8A-8C, respectively. One sill panel 12 or 13 and one header panel 14, 15, 16, or 17, along with reinforced U blocks (shown in FIGS. 12G and 13A) positioned on opposing side thereof, form an opening for a window frame and a window. Sill panel 12 includes two flat faced sides 12*a*, 12*b*, and a flat top 12*c*. Sill panel 13 also includes two flat faced sides 13*a*, 13*b*, and a top 13*c* which includes a U-shaped recess 13*d* (shown via phantom lines in FIG. 4B) which may include rebar 31 and concrete and/or cementitious material 33 in recess 13*d*.

Figure 5A:
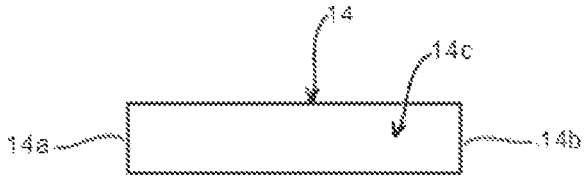
FIG. 5A is a top plan view of header panel according to the present invention.
Figure 5B:
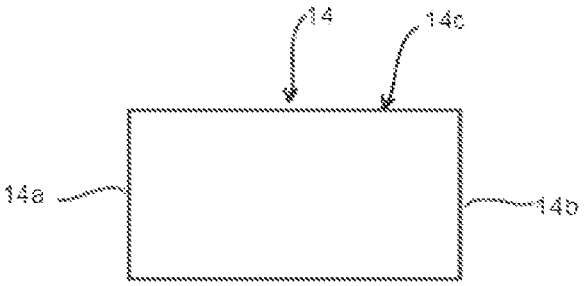
FIG. 5B is a front view of the header panel of FIG. 5A.
Figure 5C:
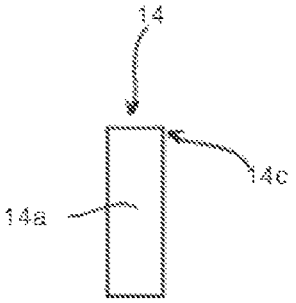
FIG. 5C is a side view of the header panel of FIGS. 5A and 5B.
Figure 6A:
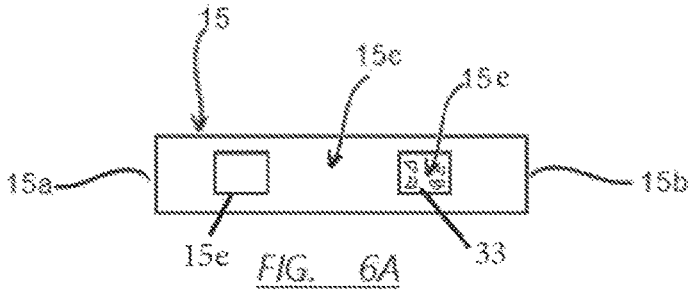
FIG. 6A is a top plan view of an alternative header panel according to another embodiment of the present invention, showing recesses therein.
Figure 6B:
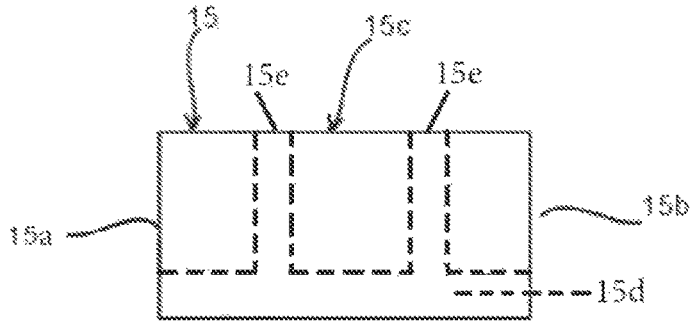
FIG. 6B is a front view of the header panel of FIG. 6A, but showing via phantom lines vertical voids and a lower horizontal recess.
Figure 6C:
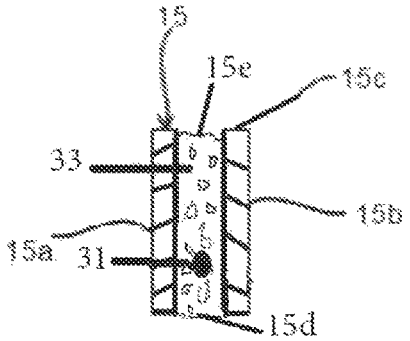
FIG. 6C is a cross-sectional view of the header panel of FIGS. 6A and 6B, showing the horizontal recess and by phantom lines showing one vertical void therein.
Figure 7A:
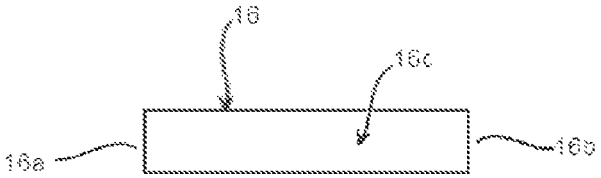
FIG. 7A is a top plan view of a gable header panel according to the present invention.
Figure 7B:
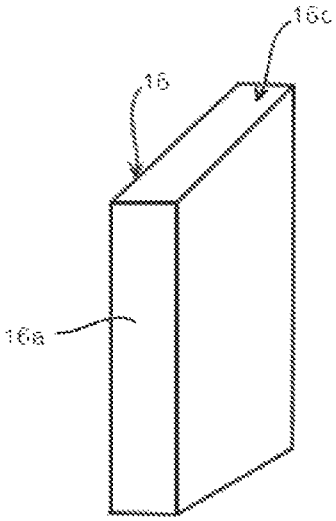
FIG. 7B is a perspective view of the gable header panel of FIG. 7A.
Figure 7C:
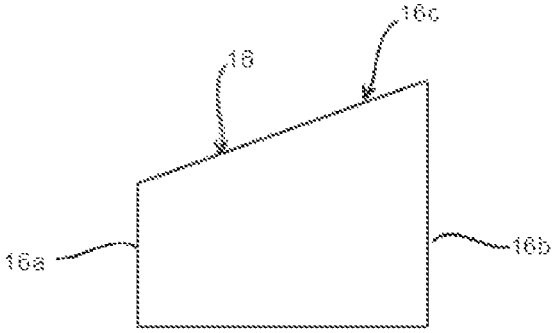
FIG. 7C is a front view of the gable header panel of FIGS. 7A and 7B.

Standard molded headers having different features are illustrated in FIGS. 5A-5C and 6A-6C. FIGS. 5A-5C shows header panel 14, which includes two flat faced sides 14*a*, 14*b*, and flat top 14*c*. FIGS. 6A-6C are similar to FIGS. 5A-5C, except that the molded header 15 is reinforced and includes a plurality of pre-formed voids (one of the voids identified by numeral 15*e*) on a top surface 15*c* thereof, and a recess 15*d* is formed in a length of a lower surface thereof. It should be noted that for FIGS. 6A-6C, such recesses and voids 15*e* and 15*d* may be filled with rebar 31 and/or concrete and/or cementitious material 33, as shown in FIG. 6C.

Figure 8A:
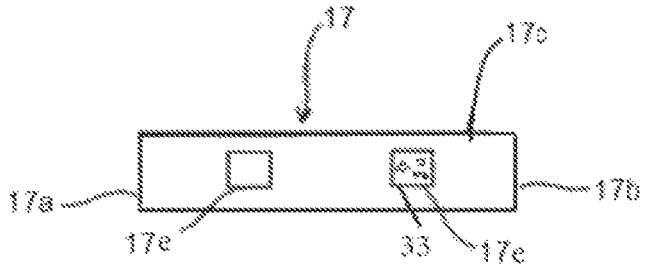
FIG. 8A is a top plan view of an alternative gable header panel with vertical voids formed in the top surface thereof according to another embodiment of the present invention.
Figure 8B:
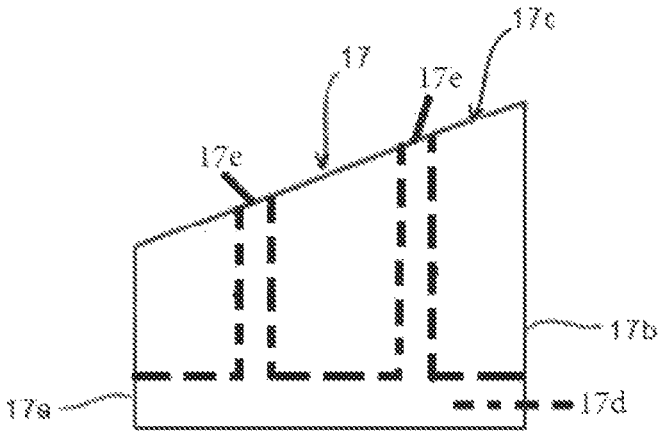
FIG. 8B is a front view of the gable header of FIG. 8A but showing via phantom lines vertical voids and a lower horizontal recess.
Figure 8C:
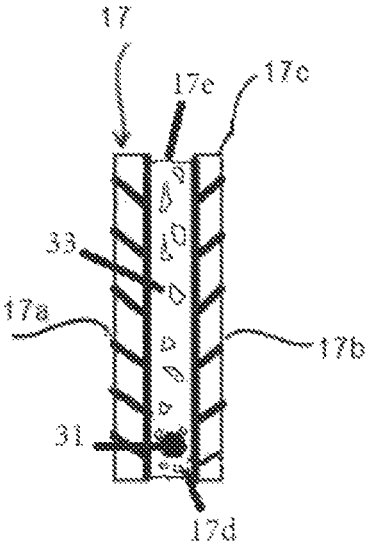
FIG. 8C is a cross sectional view of the gable header of FIGS. 8A and 8B, showing the horizontal recess and by phantom lines showing one vertical void therein.

FIGS. 7A-7C and FIGS. 8A-8C illustrates alternative molded headers, namely, a gable header panel 16 which includes two flat faced sides 16*a*, 16*b*, and angled top 16*c*. FIGS. 8A-8C are similar to FIGS. 7A-7C, except that the header 17 includes a plurality of pre-formed voids 17*e* on a top surface 17*c* thereof, and a U-shaped void 17*d* is formed in a lower surface thereof. Voids 17*e* and recesses 17*d* may be filled with the rebar 31 and/or at least one of concrete and cementitious materials 33 described herein as well (FIG. 8C).

Figure 12A:
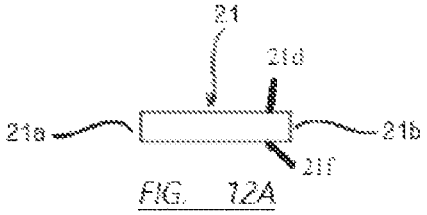
FIG. 12A is a side view of a U block cap according to the present invention.
Figure 12B:
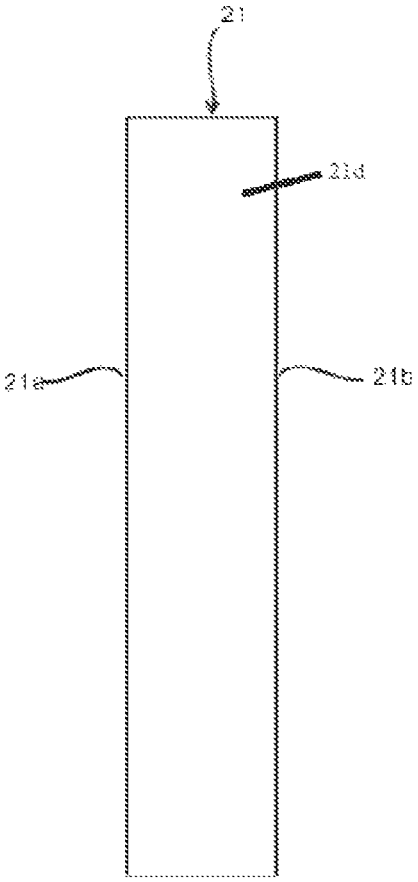
FIG. 12B is a top plan view of the U block cap of FIG. 12A.
Figure 12C:
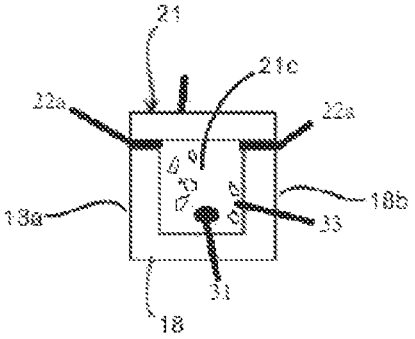
FIG. 12C is a side view of the U block cap of FIG. 12A positioned against the U block of FIGS. 9A-9C to form a void within the U block.
Figure 12D:
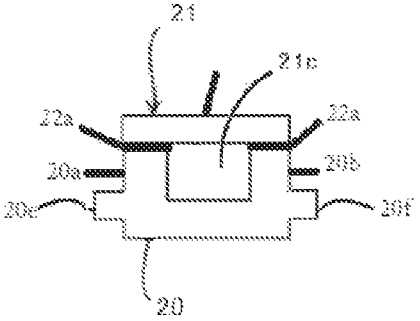
FIG. 12D is a side view of the U block cap of FIGS. 12A and B positioned against the U block of FIGS. 11A-11C to form a void within the U block.
Figure 12E:
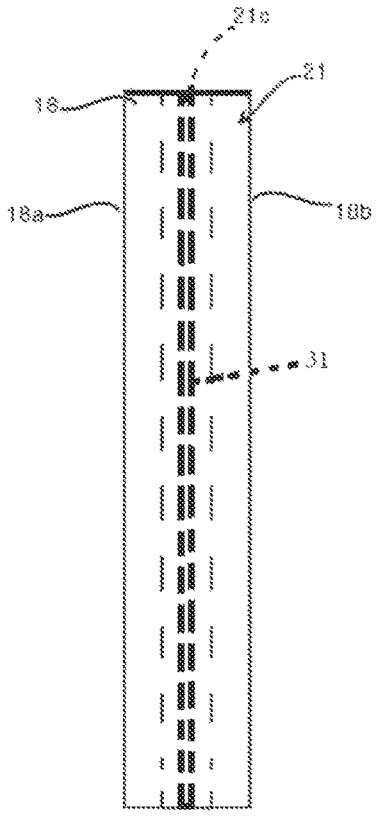
FIG. 12E is a front view of a U block having a U block cap positioned in a sealing position thereover, showing the void formed therein via phantom lines according to the present invention.
Figure 12F:
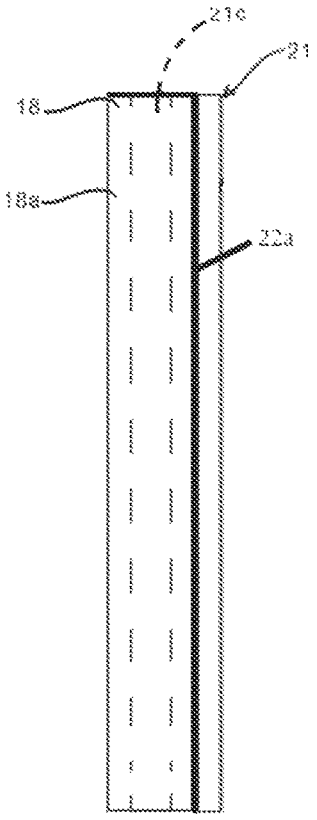
FIG. 12F is a side view of the U block having a U block cap positioned in a sealing position thereover of FIG. 12E.
Figure 12G:
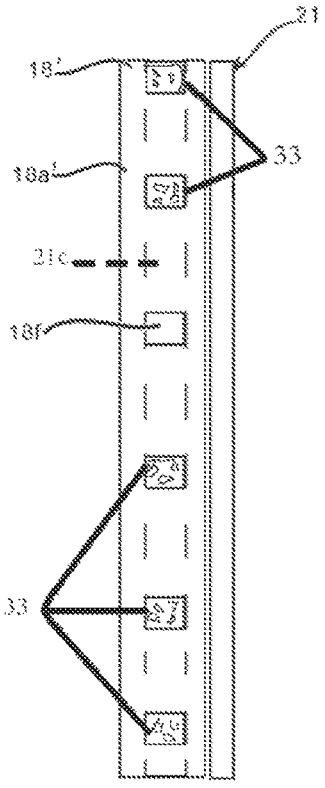
FIG. 12G is a side view of the U block having a U block cap similar to FIG. 12F, but showing a plurality of recesses formed along a side of the U block according to another embodiment of the present invention.

A primary structural component of each wall are U blocks. U blocks are positioned vertically as well as horizontally or at angles within a wall structure to provide additional support thereto. Some U blocks 18' (as shown in FIG. 12G) are specially designed and molded (namely, are further reinforced via recesses 18*f*) to surround doors and other openings, such as windows, thereby eliminating the need to cut openings and find a way to reinforce the structure for windows and/or doors, as an after-thought of the engineered building plan. The U blocks 18' of FIG. 12G provide increased security for a building constructed via the building assembly shown and described herein.

Figure 9A:
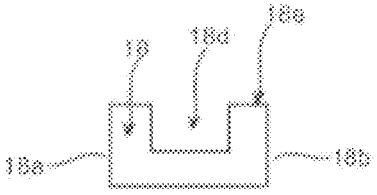
FIG. 9A is a side (end) view of a U block illustrating a recess therein according to the present invention.
Figure 9B:
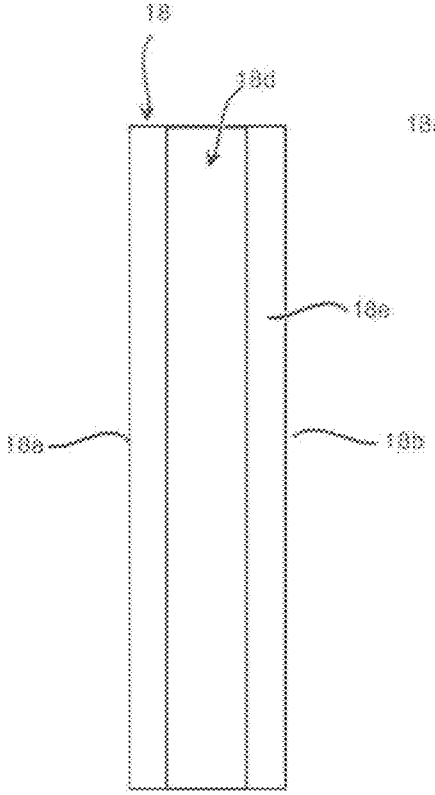
FIG. 9B is a top plan view of the U block of FIG. 9A, showing the recess therein.
Figure 9C:
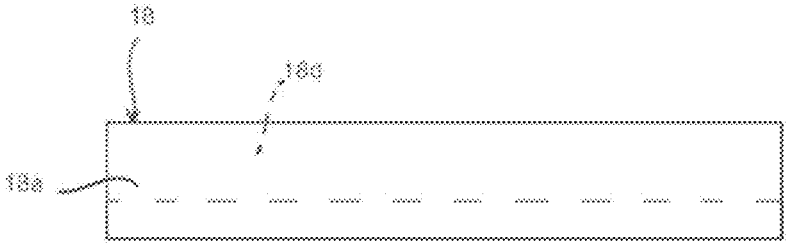
FIG. 9C is a side view of the U block of FIGS. 9B and 9C, showing via phantom lines the recess within the U block.
Figure 10A:
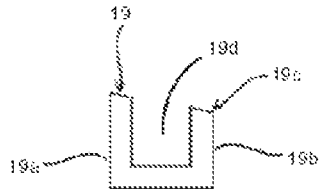
FIG. 10A is a side view of an alternative U block having angled side walls on each side of a recess formed therein according to another embodiment of the present invention.
Figure 10C:
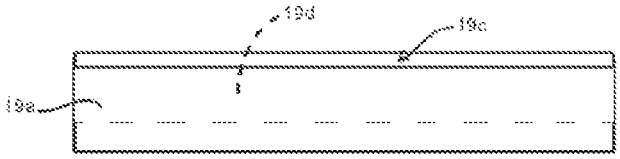
FIG. 10C is a side view of the U block of FIGS. 10A and 10B, but showing both the angled side walls and via phantom lines the recess within the U block.
Figure 10B:
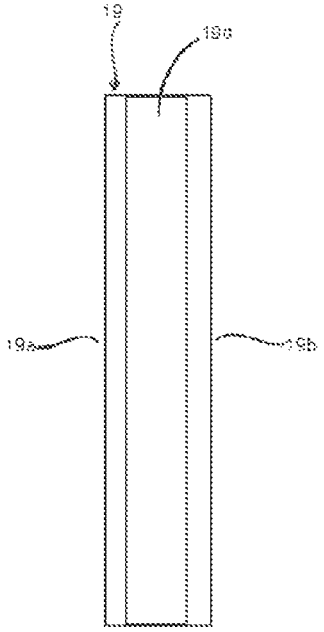
FIG. 10B is a top plan view of the U block of FIG. 10A having angled side walls.
Figure 13A:
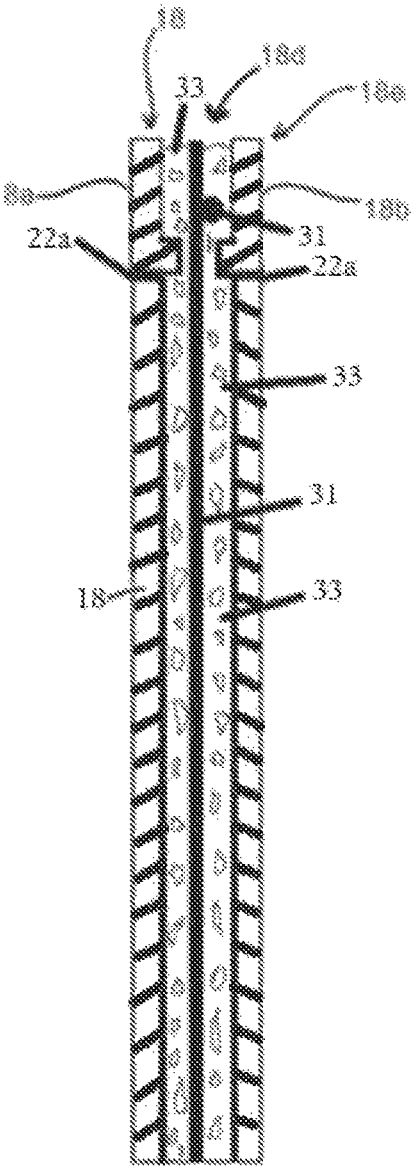
FIG. 13A is a cross sectional view of a wall structure assembly, the cross section through the vertical U blocks of FIG. 12E and the horizontal U-blocks of FIGS. 9A-9C forming a portion of the side wall, the U blocks each having a recess therein according to the present invention.

FIGS. 9A-9C illustrates a U block 18 which includes sides 18*a*,18*b*, and flat top 18*e*. Flat top 18*e* includes a recess 18*d* along the length of the U block 18 in FIG. 9B. As illustrated in FIG. 13A, rebar 31 and at least one of concrete and cementitious material 33 is desirably positioned within recess 18*d*. An alternative U block 19 is illustrated in FIGS. 10A-10C, which is similar to U block 18, except that U block 19 includes sides 19*a*, 19*b*, and angled top 19*c*. Angled top 19*c* includes a recess 19*d* positioned therethrough (recess 19*d* being shown in phantom lines in FIG. 10C). It will be appreciated that rebar and at least one of concrete and cementitious material, while not illustrated, is desirably positioned in the recess, just as shown in similar U block 18 of FIG. 13A.

Figure 11A:
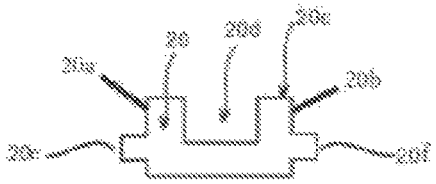
FIG. 11A is a side view of an alternative U block having a recess and protuberances extending outwardly from each side wall according to another embodiment of the present invention.
Figure 11B:
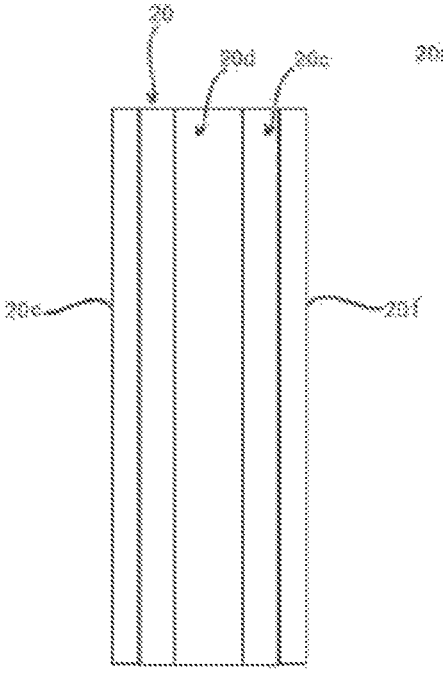
FIG. 11B is a top plan view of the U block of FIG. 11A showing protrusions and the recess.
Figure 11C:
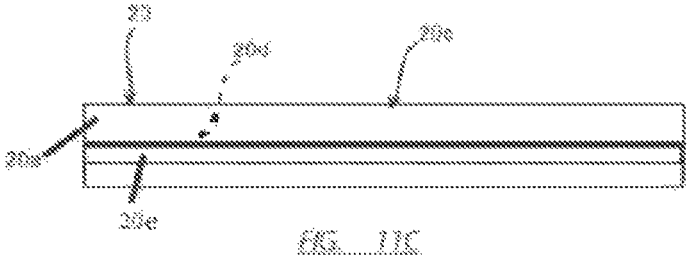
FIG. 11C is a side view of the U block of FIGS. 11A and 11B showing a protrusion along the side.

An alternative U block 20 is shown in FIGS. 11A-11C. U block 20 is similar to U block 19, in that it includes sides 20*a*, 20*b*, and recess 20*d* formed in surface 20*c*. However, protrusions 20*e*, 20*f* extend outward from sides 20*a*, 20*b*, respectively, and along the length of U block 20. These U blocks may be used with roof panels, which will be illustrated and described in detail below.

Figure 14A:
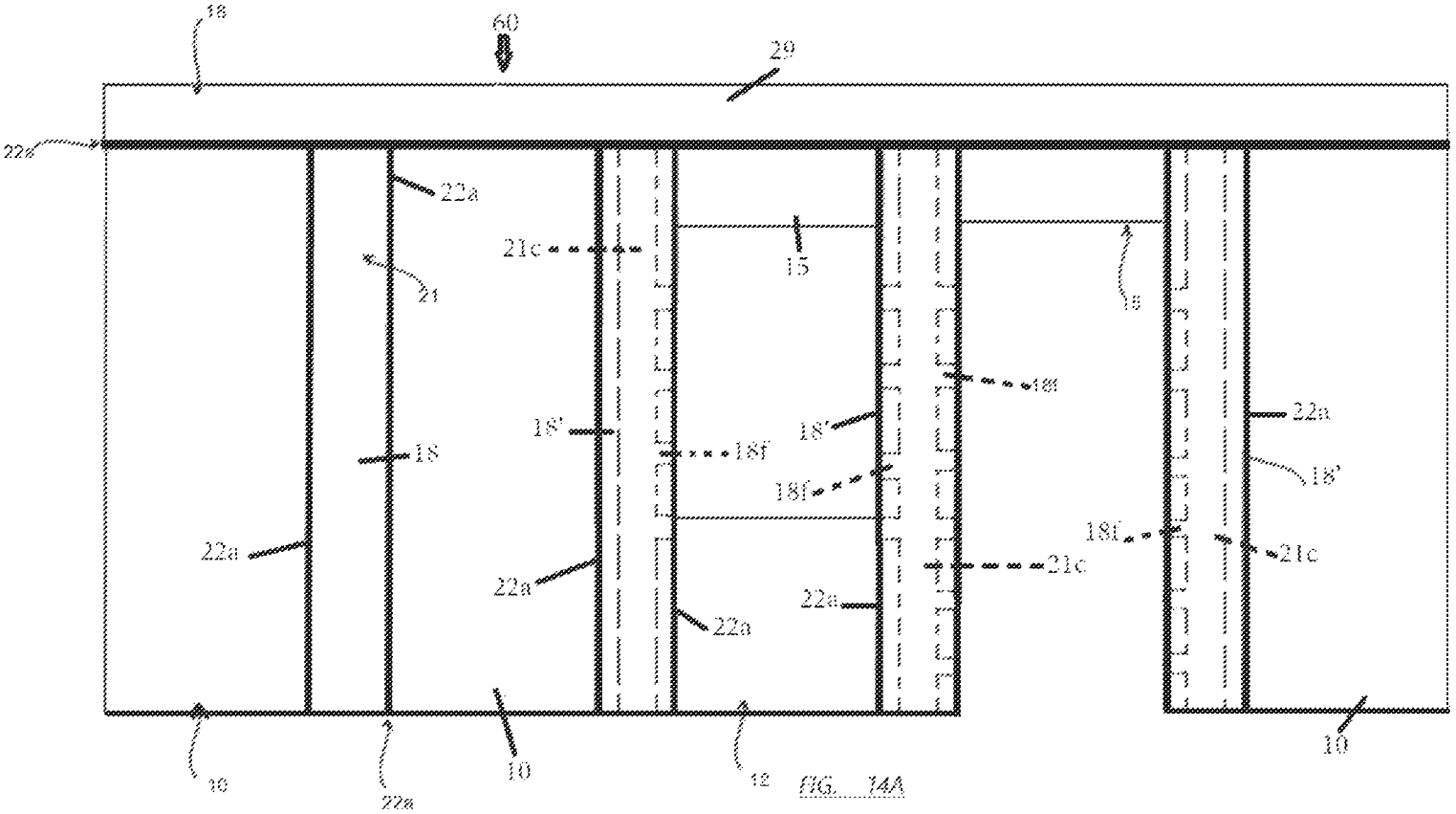
FIG. 14A is a front view of a wall structure assembly which includes a perimeter formed for a window and a perimeter formed for a door formed from U blocks, U block caps, header panels, sill panels, wall panels and voids according to the present invention.
Figure 14B:
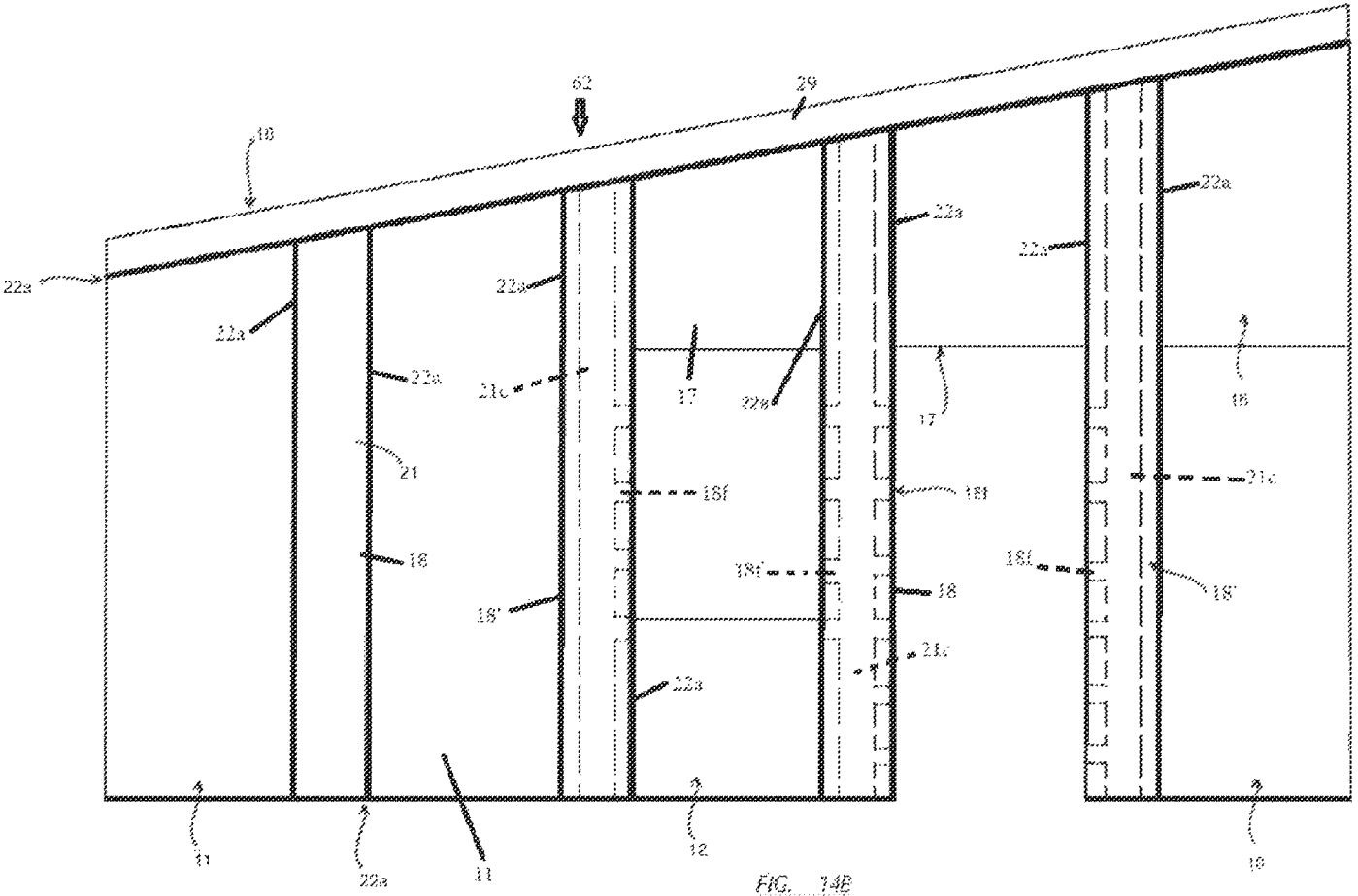
FIG. 14B is a front view of a wall assembly similar to the wall assembly of FIG. 14A, but showing a gable wall assembly.

Molded or preformed U block caps are joined to U blocks by the adhesive, to provide a closed void in the U blocks. FIGS. 12A-12G illustrates the U block cap 21 which is adhered via the adhesive 22*a* to the U block 18 (FIG. 12C) or to U block 20 (FIG. 12D). The U cap 21 includes sides 21*a*, 21*b*, top side 21*d* and lower side 21*f*, as shown in FIGS. 12B-12D. FIG. 12C shows U cap 21 which covers the recess and forms the void 21*c* within U block 18 via the adhesive 22*a*, and showing rebar 31 and concrete and/or cementitious material 33 in the void 21*c*. FIG. 12E illustrates a front elevational view of U cap 20 covering U block 18 (phantom lines represent void 21C in U block 18 and darker double phantom lines therewithin illustrate rebar 31 positioned therein). FIGS. 12F and 12G each provide a side view of the U caps 21 sealing U block 18 and U block 18', respectively. U blocks 18 (FIG. 12F) and 18' (FIG. 12G) each includes phantom lines to represent the void 21*d* formed within each U block 18, 18' by use of U block caps 21. U block 18 of FIG. 12F also illustrates the adhesive 22*a* which holds the U block cap 21 in position. U block 18' illustrates additional recesses on one side (which alternatively may also be on each opposing side thereof), such as, for example, plurality of recesses 18*f* (only one of the plurality of recesses identified by numeral 18*f*) as shown in FIGS. 12G, 14A, and 14B. FIG. 12G also illustrates that when the void 21*c* of U block 18' is filled with concrete and/or cementitious material 33, the concrete and/or cementitious material 33 fills each recess 18*f* of the plurality of recesses. It will be understood that at least in some instances, the U block cap 21 will be applied via adhesive 22*a* to the U block after rebar 31 is positioned therein and connected to additional rebar 31, as described in detail herein, but before concrete and/or cementitious material 33 is poured into the void 21*c* extending through the length of the U block 18. For example, but not by way of limitation, all U blocks 18, 18' positioned vertically will have the U block cap 21 adhered thereto prior to pouring the concrete and/or cementitious material 33 therein. In U block 18' of FIG. 12G, when the concrete and/or cementitious material is poured into the void 21*c*, the concrete and/or cementitious material flows through the plurality of recesses 18*f* (only one of the plurality indicated by number 18*f*) to provide a strengthened area forming a perimeter for door frames and doors as well as window frames and windows. Forms may be temporarily used at this time at sides of the U blocks 18', to enhance the perimeter shape for window frames and windows, and door frames and doors.

Figure 13B:
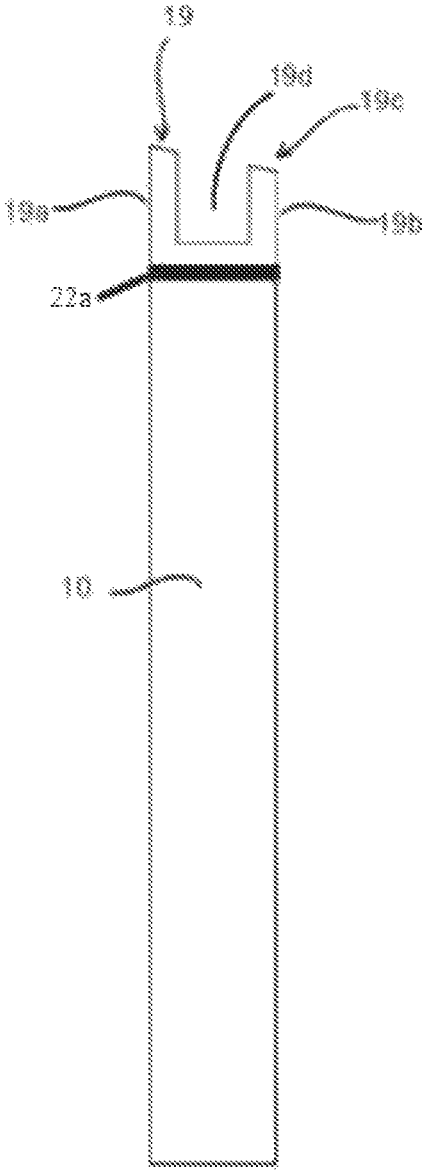
FIG. 13B is a side view of an alternative embodiment of a wall structure assembly wall having the U block of FIGS. 10A-10C horizontally positioned on a top surface of the side wall, the U block having angled side walls.

U blocks are also positioned horizontally or at an angled position for gabled walls on top of vertical walls and headers, as shown in FIGS. 13A and 13B. Such horizontal U blocks 18, 19 are positioned over vertical U blocks 18, 18' wall panels 10, 11 and the like, as shown in FIGS. 14A and 14B. Further, horizontal U blocks 18, 19 include in their recesses 18*d*, 19*d*, respectively, a plurality of openings 18*g* (FIG. 14C), each opening 18*g* aligned with each void 21*c* of vertical U blocks 18 which permits rebar 31 in the vertical U block 18 to extend upward through opening 18*g* to connect to rebar 31 in the horizontal U block, and such vertical extending rebar 31 extends upward a distance to connect with additional rebar 31 in U blocks 18 associated with roof panels, as illustrated and described in detail below. In addition, only after rebar 31 is positioned and connected, are the vertical U blocks 18, 18', capped with U block caps 21. To illustrated this feature, FIG. 13A is a cross section of horizontal U block 18 and vertical capped U block 18, with rebar 31 and concrete and/or cementitious material 33 positioned therein, the concrete and/or cementitious material 33 which has flowed through each opening 18*g* (FIG. 14C) of horizontal U block 18 into the vertically aligned void 21*c* of each vertical U block 18 and has filled the void 21*c* of the vertical U block 18. In addition, horizontal U blocks 18 cooperate with the vertical U blocks 18 to form additional structure via their internal content of rebar and concrete and/or cementitious material. FIG. 13B shows the views of a U block 18 with recess 18*d* positioned on top of wall 10, and U block 19 with recess 19*d* positioned on top of another wall 10, respectively. Similar to FIG. 13A, U block 19 and wall panel 10 of FIG. 13B desirably will also have rebar 31 and concrete and/or cementitious material 33 positioned therein as well.

Figure 14C:
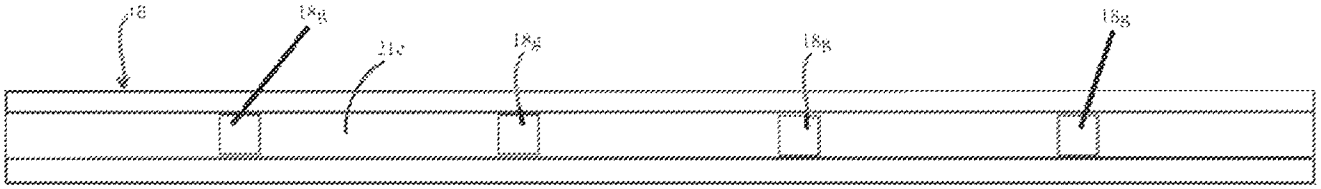
FIG. 14C is a top plan view of the wall assembly of FIG. 14A, showing the voids of the horizontal U block which connect to voids in the vertical U blocks, as well as the recess in the horizontal U block.

FIGS. 14A thru 14C illustrate a structural wall assembly 60 formed from some of the previously described building components. Turning to FIG. 14A, the structural wall assembly 60 of FIG. 14A includes an adhesive 22*a* which joins vertical U blocks 18 and 18' (and joins the U block cap(s) 21 to the U blocks 18 and 18') and horizontal U blocks 18 (forming wall beams 29) to wall panels 10, header panel 15, and sill panel 12. These building components cooperate to form the structural wall assembly 60. Window and door openings are formed by U blocks 18' which have a plurality of recesses 18*f* on at least one side thereof, and each recess 18*f* of the plurality of recesses fluidly connects to the void 21*c*. When rebar 31 and concrete and/or cementitious material 33 are positioned in the void 21*c*, a portion of the concrete and/or cementitious material 33 flows from the void 21*c* to fill each recess 18*f* of the plurality of recesses and strengthen a perimeter designed for a window frame and a window, and a perimeter designed for a door frame and a door, as illustrated in FIG. 14A. Temporary forms may be applied to U blocks 18' having recesses 18*f*. Horizontal U blocks 18 include a recess which extends along a portion of an upper surface thereof to carry rebar and the concrete and/or cementitious material therein, and are positioned above and form a portion of the structural wall assembly 60 (shown in FIGS. 13A and 13B). The horizontal U blocks 18 cooperate with vertical U blocks 18, 18' to provide a reinforced structure for the structural wall assembly 60. Horizontal U blocks 18 may or may not include U block caps 21.

While each building component mentioned herein may be used to build a wall structure vertically component by component, desirably a building plan describes each component for, example but not by way of limitation, an outer wall of a building such as structural wall assembly 60 or 62. Such a structural wall assembly 60, 62 desirably may be built by placing all components on a flat surface and adhering or otherwise connecting them together. Such a structural wall assembly 60, 62 would include all wall structures, wall panels 10 or 11, including vertical U blocks 18, 18' and horizontal or angled U blocks 18, 19 (each of U blocks 18 and 19 providing wall beams 29, and may be referred to as a second portion of the plurality of U blocks). Structural wall assemblies 60, 62, once assembled, may be positioned vertically on a floor or foundation 32 and adhered thereto and/or otherwise connected in any manner known in the art. It will be appreciated that recesses (or voids when the U block is capped) of vertical U blocks 18, 18' of such outer walls would be aligned with rebar 31 in the foundation 32, so that rebar 31 which is or will be positioned in the vertical U blocks 18 or 18' may connect thereto. Similarly, openings 18*g* (FIG. 14C) will be positioned in the horizontal or angled (second portion) of U blocks 18/wall beams 29, to connect to the voids of the vertical U blocks. Rebar 31 positioned vertically in the voids of the first portion of the plurality of U blocks, namely, the vertical U blocks 18, 18', will extend therethrough and through the opening(s) 18*g* in the second portion of the horizontal and/or angled U blocks 18, 19 (wall beams 29) and desirably connects to rebar 31 in the third portion of the plurality of U blocks, namely, the U blocks 18 which may form a portion of the roof panels, and may also connect to rebar in the horizontal or angled U blocks 18, 19, (wall beams 29) (second portion of U blocks). The third portion of U blocks 18 receives rebar 31 and concrete and/or cementitious material 33 in the recess therein and then desirably may be capped by U block caps 21 thereafter, which permits pouring of all concrete and/or cementitious material 33 in one single pour at one single time, saving time, money, and creating a stronger structure.

FIG. 14B shows an alternative structural gable wall assembly 62 which is similar to the structural wall assembly shown in FIG. 14A. The structural gable wall assembly includes an adhesive 22*a* joining U blocks 18 or 18' and their respective U block cap(s) 21 together. Adhesive 22*a* also connects capped U blocks 18 and/or 18' to gable header 17, sill panel 12, or gable wall panels 11 to each other as previously described in detail above to form the structural gable wall assembly 62. It will be appreciated that with a structural gable wall assembly 62, the U blocks 18 (wall beams 29) positioned above wall panels 11 and header 16 are positioned at an angle.

FIG. 14C shows the top plan view of the structural wall assembly 60 which illustrates (second portion) horizontally U blocks 18 with recesses 18*g* formed therein to align with voids 21*c* of U blocks (left to right) vertical U blocks 18, 18', 18', and 18', respectively (one view illustrated in FIG. 13A).

Figure 20A:
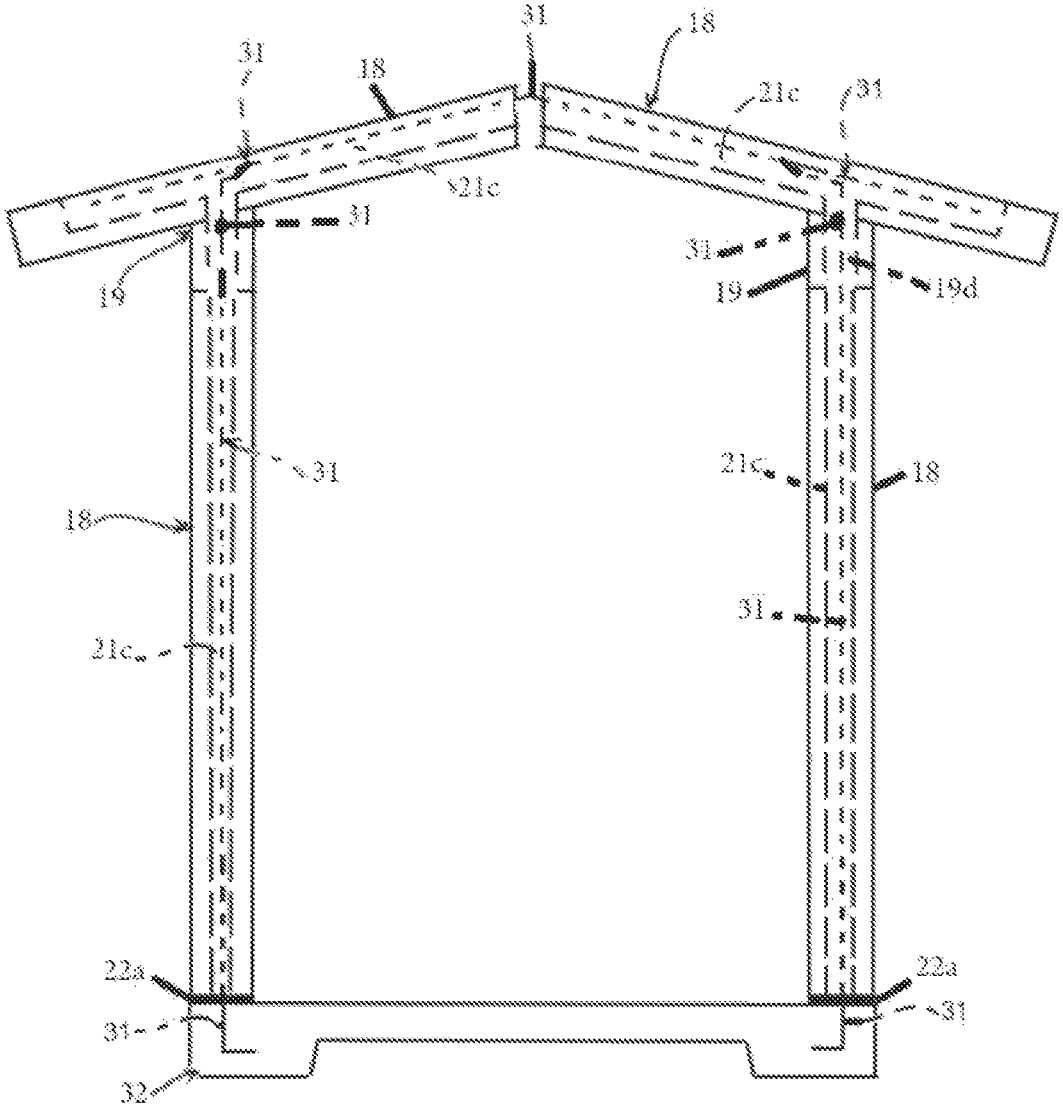
FIG. 20A is a side elevated view of a building assembly illustrating the foundation and vertical U blocks and voids therein with rebar (both shown in phantom lines), horizontal U blocks positioned above the vertical U blocks (with vertical rebar connecting with horizontal rebar shown by phantom lines in the horizontal U blocks), the vertical rebar extending into the angled U blocks with voids therein and the vertical rebar connecting to the angled rebar in the angled U blocks 18 forming a portion of the roof (shown by phantom lines), the rebar connecting at an apex of the roof, such that rebar connected at the foundation 32 extends through vertical U blocks to connect to horizontal rebar and angled rebar (shown in phantom lines)

Moving forward to FIG. 20A, rebar 31 is desirably connected to both sides of a foundation 32. Additional rebar 31 is positioned in voids 21*c* of opposing vertical U blocks 18 forming a portion of wall structures and connects to the rebar 31 on opposite sides of the foundation 32. The rebar 31 extends upward through both vertical U blocks 18 and may connect with horizontally rebar 31 positioned in voids of horizontal U blocks 19 (FIG. 13A), and the rebar 31 from the vertical U blocks 18 may extend upward to connect with rebar 31 in the voids 21*c* of angled U blocks 18 included in roof panels. Rebar 31 from U block 18 used in roof panels may, but not by way of limitation, interconnect at a roof apex 78 (FIG. 20B), or near the apex, or to roof supports of the roof assembly. The rebar 31 will be surrounded by concrete and/or cementitious material (FIG. 13A) when it is positioned in any U block shown and described herein.

Figure 15A:
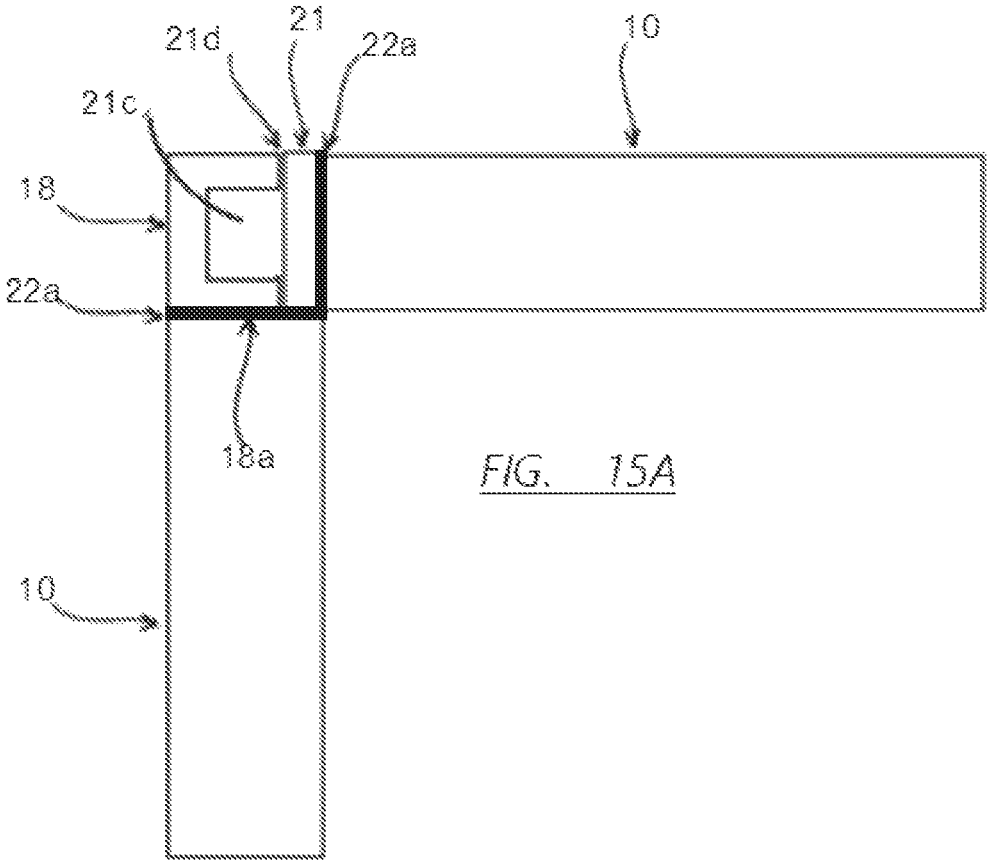
FIG. 15A is a top plan view of two wall panels having a U block with a U block cap thereof positioned between the wall panels and forming a 90 degree corner therewith according to the present invention.

Returning to FIG. 15A, the illustrated U block 18 forms corners for the building assembly when attached to wall panels 10 or 11. FIG. 15A shows the U block 18 positioned at an angle between one wall panel 10 and another wall panel 10 in a 90 degree angle configuration. U block 18 also includes U block cap 21, which is connected to U block 18 to enclose the void 21*c* therein, thereby desirably, but not by way of limitation, forming a square inner perimeter or a rectangular inner perimeter to form the void 21*c* therein, and a square outer perimeter or rectangular outer perimeter as well, of the U block 18 with U block cap 21. The adhesive 22*a* is used to adhere a side of each wall panel 10 to a side of the U block 18. It will be appreciated that other corner connections between the wall panels 10, 11 and U block 18 are also possible, and the foregoing is only one example thereof.

Figures 16A, 16C, 16D:
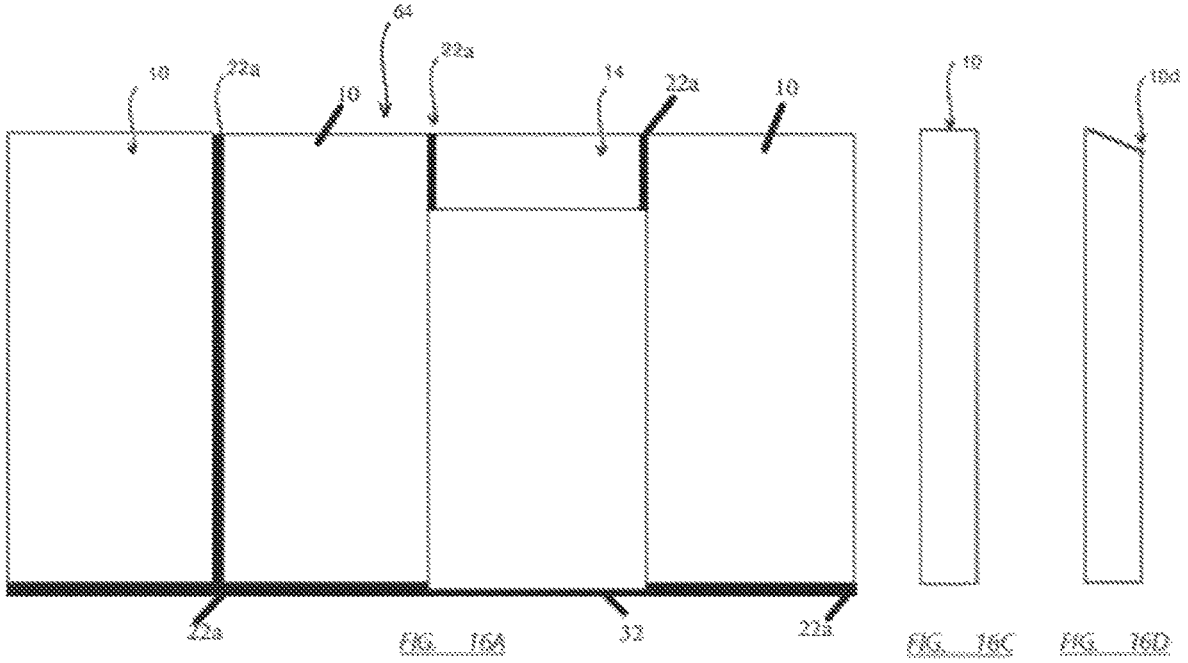
FIG. 16A is a front view of an internal partition wall assembly including flat top wall panels of FIGS. 1A-1C and the flat top header panel of FIGS. 5A-5C according to the present invention.
FIG. 16C is a side view of the wall assembly of FIG. 16A.
FIG. 16D is a side view of the angled wall assembly of FIG. 16B.

A partition internal wall assembly 64 is shown in FIGS. 16A-16D. The partition internal wall assembly, as illustrated in FIG. 16A, includes (from left to right), wall panel 10, adhesive 22*a*, another wall panel 10, adhesive 22*a*, header 14, adhesive 22*a*, and yet another wall panel 10 to form the partition internal wall assembly 64. The combination of wall panel 10, header 14, and wall panel 10 also form a door opening within the partition wall assembly. FIG. 16C illustrates a side view of the present partition wall panel assembly. FIG. 16D shows a side view of an angled top of the partition wall panel assembly. It will be appreciated that the partition internal wall panel assembly 64 is not used to form load bearing walls. The partition internal wall panel assembly 64 is desirably connected via an adhesive 22*a* to a floor or foundation 32. The partition internal wall panel assembly 64 may also be connected to an inner surface of a ceiling or roof assembly (not shown).

Figure 16B:
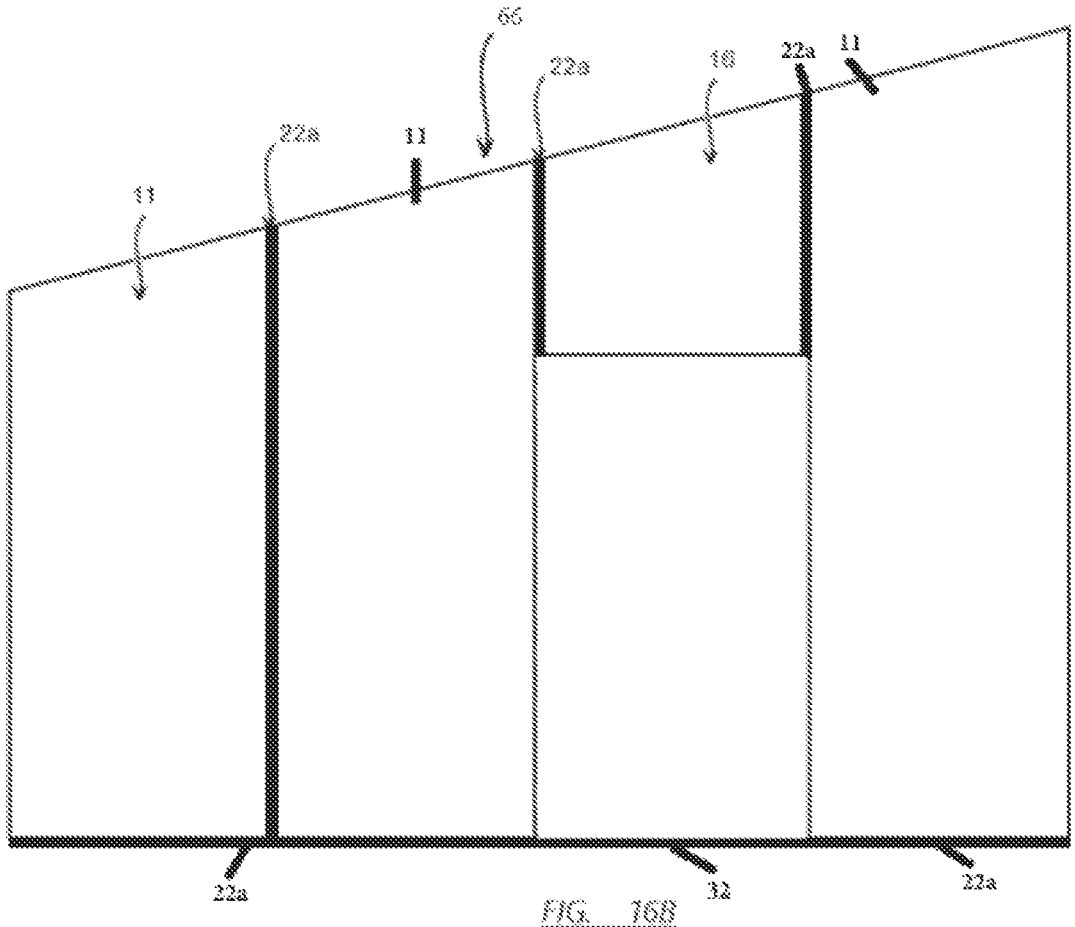
FIG. 16B is an alternative front view of an internal partition wall assembly including gable wall panels of FIGS. 2A-2C and the gable header panel of FIGS. 7A-7C according to another embodiment of the present invention.

FIG. 16B shows an alternative partition internal wall assembly 66 that forms a gabled wall. This alternative partition internal wall assembly 66 includes (from left to right), gable wall panel 11, adhesive 22*a*, another gable wall panel 11, adhesive 22*a*, gable header 16, adhesive 22*a*, and still another gable wall panel 11 to form the alternative partition wall assembly 66. The combination of wall panel 11, header 16, and wall panel 11 also form a door opening within the alternative partition internal wall assembly 66. The alternative partition internal wall panel assembly 66 is desirably connected via an adhesive 22*a* to a floor or foundation 32 (FIG. 20A). Again, it will be appreciated that alternative partition internal wall assemblies 64, 66 may preferably be used for non-load bearing walls. The partition internal wall panel assembly 66 may also be connected to an inner surface of a ceiling or roof assembly (not shown).

A roof may comprise U blocks, U block caps, roof panels, H connectors and/or T connectors. Support attachments may include, but not by way of limitation, purlin support brackets, roof purlin supports, connection plates, cross beams, and various fasteners.

Figure 17A:
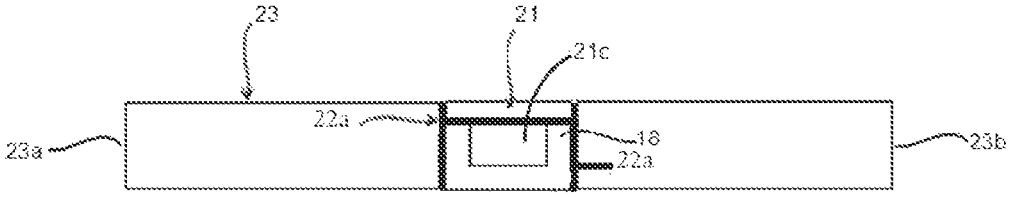
FIG. 17A is a top plan view of a roof panel assembly with two side walls connected to a U block having a U block cap according to the present invention.
Figure 17B:
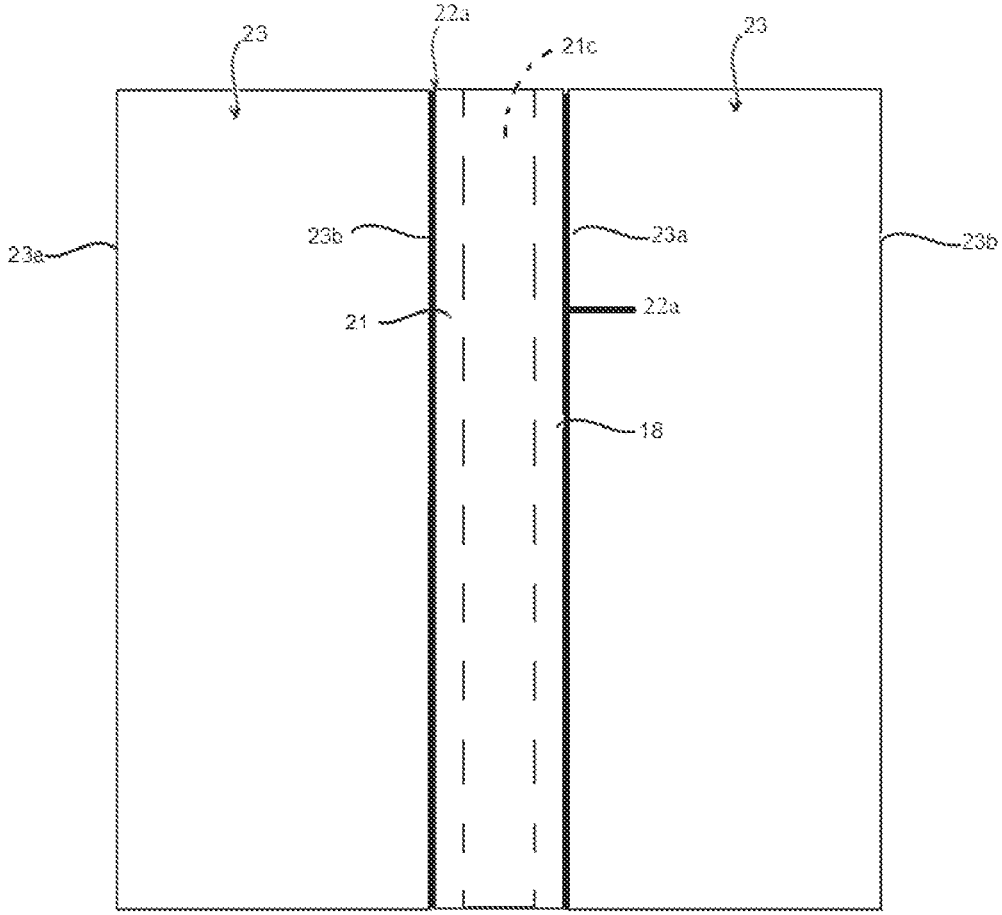
FIG. 17B is a front view of the roof panel assembly of FIG. 17A with the U block void therein shown via phantom lines.

A portion of a roof assembly is shown in FIGS. 17A-17B. This portion of the roof assembly includes roof panels 23 and a U block 18 closed by U block cap 21 via the adhesive 22*a* (which may be referred to as a "closed U block" or a "capped U block"). In this example, a roof panel 23 may be positioned along edge 23*b* (left roof panel 23) next to closed U block 18 and additional roof panel 23 (right roof panel 23) is positioned along edge 23*a* next to closed U block 18 (desirably including in void 21*c* rebar and concrete and/or cementitious material, as shown previously in FIGS. 12C and 13A). All interconnections are via the adhesive 22*a*. FIG. 17B shows a top plan view of the U blocks 18 and roof panels 23 of FIG. 17A.

Figure 18A:
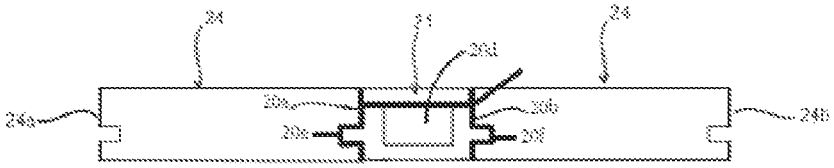
FIG. 18A is a top plan view of an alternative embodiment of the roof panel assembly similar to FIG. 17B, but showing the alternative U block having an adhesive sealed U block cap, the U block having outer protrusions on each side thereof, and showing alternative wall panels having recesses which receive the protrusions of the alternative U block therein according to the present invention.
Figure 18B:
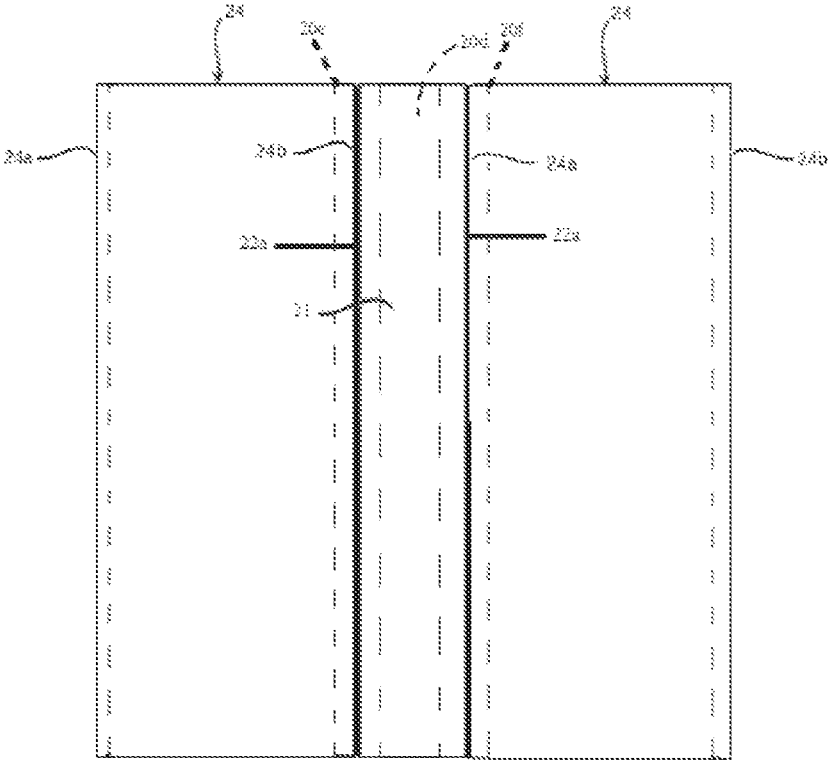
FIG. 18B is a front view of the roof panel assembly of FIG. 18A with the U block void therein shown via phantom lines and recesses in wall panels receiving protrusions shown by phantom lines.

FIGS. 18A-18B illustrates an alternative roof assembly which includes roof panels 24 with grooves 24*e* and 24*f* formed in each side 24*a* and 24*b*, respectively, to accept closed U block 20 with protrusions 20*e*, 20*f* on each side 20*a*, 20*b*, respectively. It will be understood that all interconnecting surfaces are connected to each other by the adhesive 22*a* as well as the described and shown interlocking components.

Turning now to other portions of the roof assembly, purlin support brackets are attached to concrete and/or cementitious material 33 of U blocks 18/wall beams 29 in order to receive roof support purlins 25, 26, 27.

FIGS. 19A-19E and FIGS. 20A-20D illustrate roofs with a peak beam or a truss, wherein the outside walls, i.e., the structural wall assemblies 60 or 62 have been formed in accordance with the desired roof pitch. The roof peak beam (roof apex 78) may be positioned and then reinforcement bars or supports, and the like, are connected between the roof beam and the horizontal U blocks 18, 19 (wall beams 29) of structural wall assemblies 60, 62. Thereafter, cross beams 80 may be connected thereto (FIG. 20B) and then the roof panels (FIGS. 20C, 20D) are placed on the roof structure and bonded and/or connected together until the roof is completed.

Figure 19A:
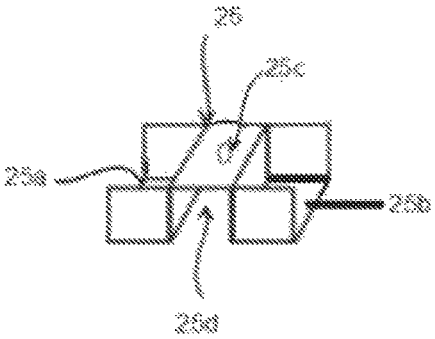
FIG. 19A is a perspective view of a two-sided roof purlin support bracket according to the present invention.
Figure 19B:
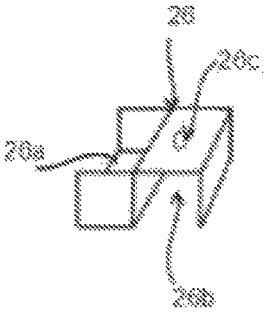
FIG. 19B is a perspective view of a one sided roof purlin support bracket having one left-sided roof purlin support.
Figure 19C:
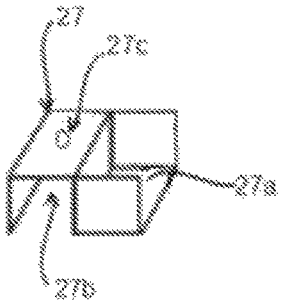
FIG. 19C is a perspective view of another one sided roof purlin support bracket having one right-sided support.

Roof purlin support brackets 25, 26, and 27 are shown in FIGS. 19A thru 19E. As illustrated in FIG. 19A, roof purlin support bracket 25 fits over a U block 18/wall beam 29, and includes a central opening 25*c* formed to receive a fastener, such as a bolt, screw, or the like, in order to connect support brackets 25, 26, and 27 to the concrete and/or cementitious material 33 of each U block 18/wall beam 29. Roof purlin support bracket 25 includes two support legs 25*a*, 25*b*, such that support leg 25*a* is positioned on one side of the wall beam 29 and support leg 25*b* is positioned on an opposite side of the wall beam 29. FIG. 19B shows a roof purlin support bracket 26 which again fits over the U block 18/wall beam 29 and includes a central opening 26*c* formed to receive a fastener. The support bracket 26 also includes one support leg 26*a* which is positioned on one side of the U block/wall beam 29. FIG. 19C illustrates roof purlin support bracket 27 which fits over the U block/wall beam 29, which includes a central opening 27*c* formed to receive a fastener. The support bracket 27 includes a leg 27*a* which is positioned on another side of the wall beam 29, relative to support bracket 26.

Figure 19D:
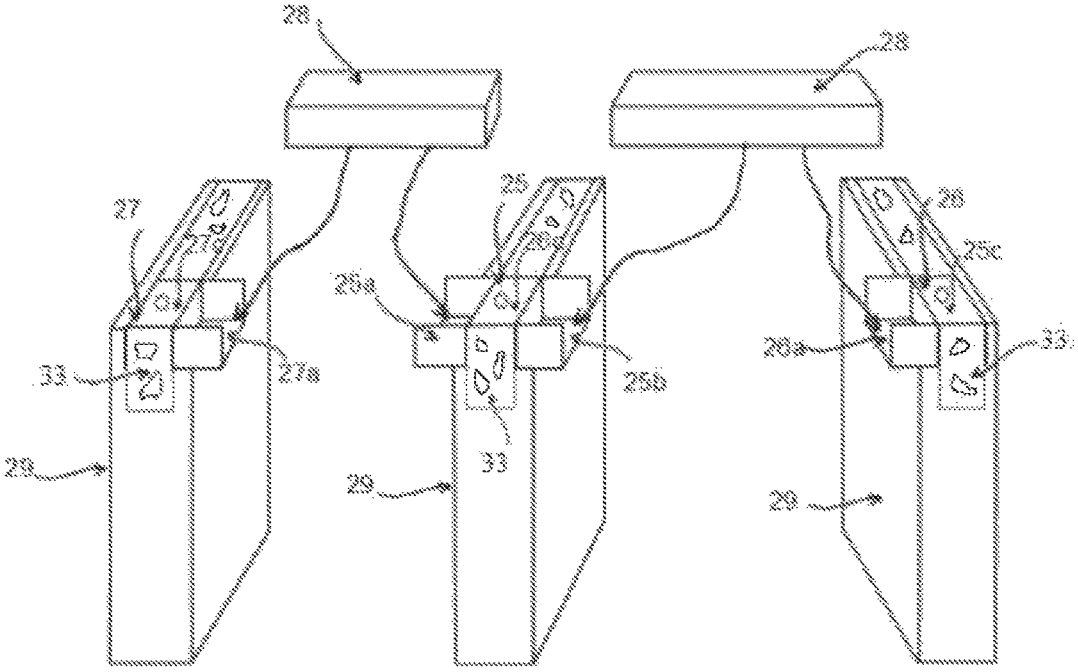
FIG. 19D is an exploded perspective view of the roof purlin support brackets of FIGS. 19A-19C showing their connection to support beams.

FIG. 19D shows three U blocks 18/wall beams 29 showing the concrete and/or cementitious material therein 33 in each wall beam 29. The roof purlin support brackets 25, 26, and 27 are placed over one of each wall beams 29, respectively, such that leg brackets 25*a*, 25*b*, 26*a*, and 27*a*, respectively are positioned to receive the roof purlin supports 28. Roof purlin supports 28 may desirably be formed from metal or other suitably material known in the art. Roof purlin support brackets and roof purlin supports are commercially available.

Figure 19E:
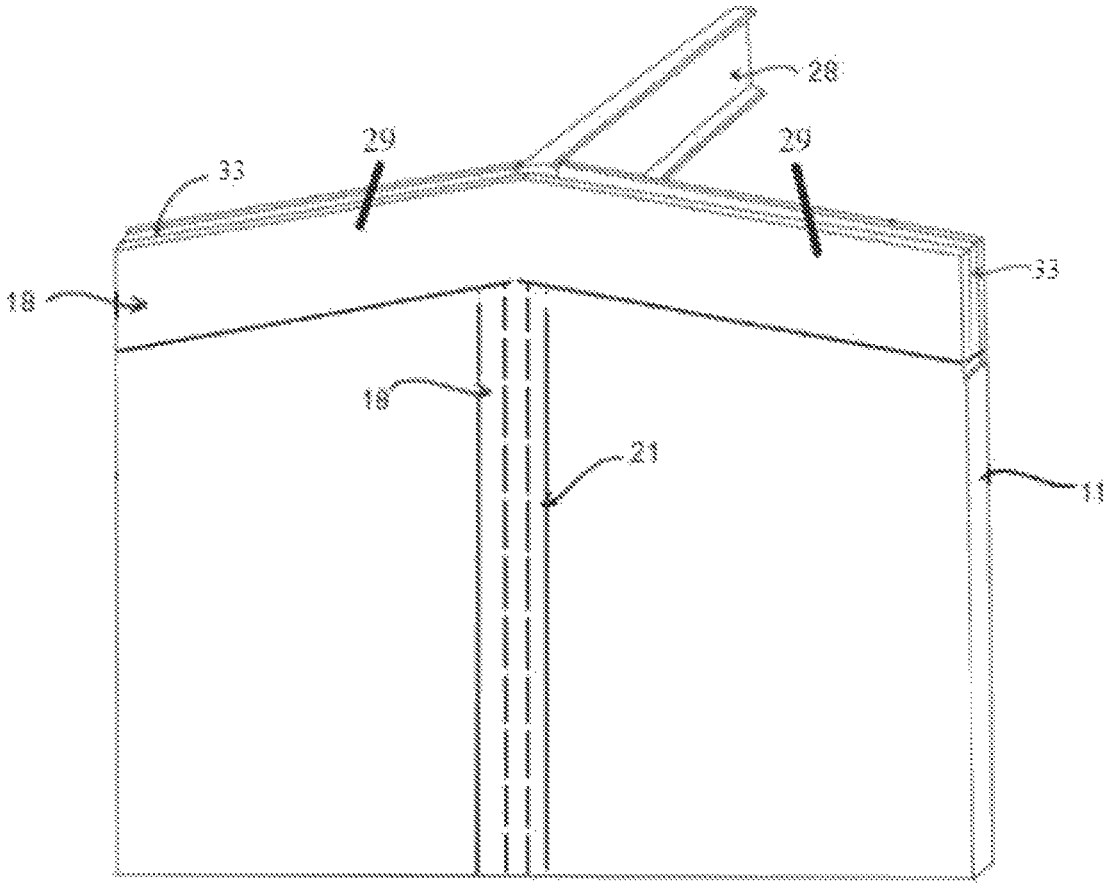
FIG. 19E is a perspective view of an end wall assembly of a building assembly having a U block with U block with cap positioned between and attached to side walls to form an end wall assembly, a U block having a U block cap positioned on top of the side walls, a roof purlin, and roof purlin support bracket according to the present invention, wherein roof purlins extend from the horizontal U blocks and angled U blocks which are positioned on top of wall panels.
Figure 20B:
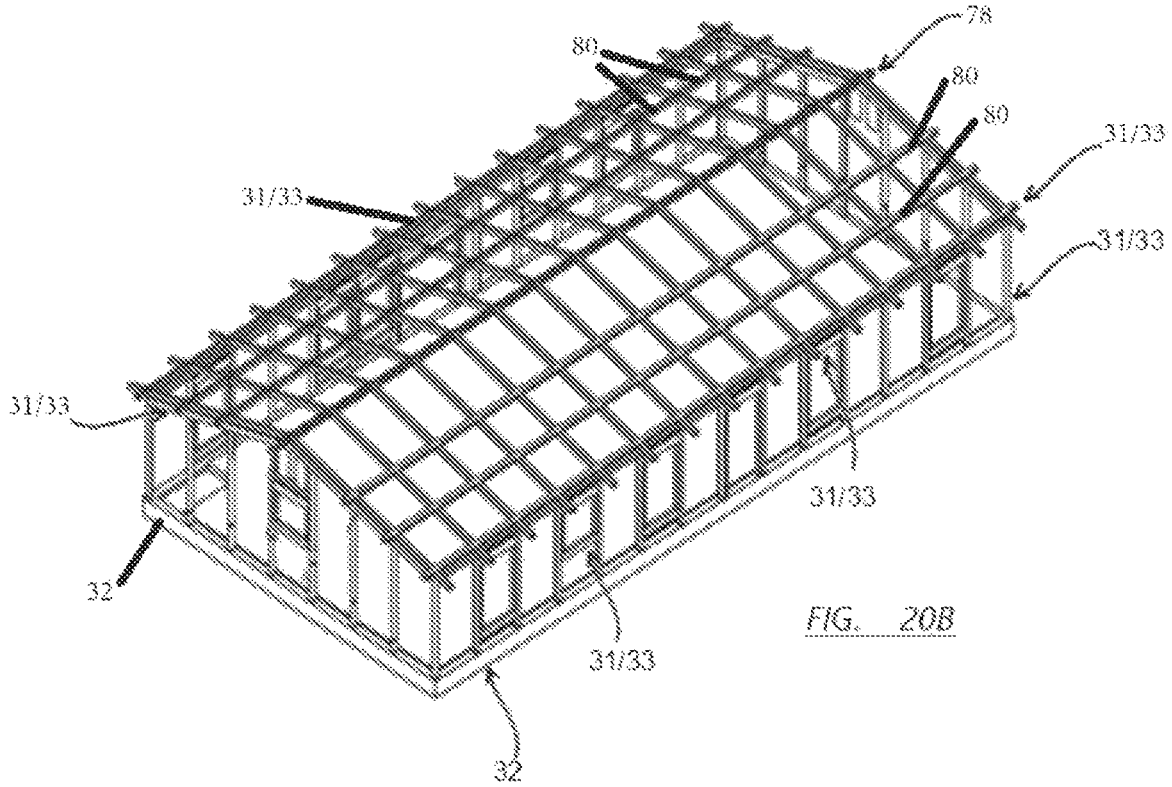
FIG. 20B is a perspective view of the building assembly illustrating all side wall and roof supports according to the present invention.

Structural wall assemblies 62 which includes a roof purlin support 28, is illustrated in FIG. 19E. The structural wall assembly 62 includes a wall panel 11, and an angled U block 18/wall beam 29 which provides rebar and concrete and/or cementitious material (shown in FIG. 13A) therein. It will be appreciated that the roof purlin support brackets (FIG. 19D) holding roof purlin support 28 is not seen in FIG. 19E. It will be understood that purlin support brackets 25, 26, or 27, as appropriate, and multiple roof purlin supports 28, are used to provide support framing for roof panels, as shown in FIG. 20B, where a plurality of roof purlin supports 28 are connected to a roof purlin support brackets at, for example, an apex 78 of at least a portion of a roof, as illustrated in FIG. 20B. Various supports extend downward to connect to roof purlin support brackets positioned on horizontal U blocks 18 on top of a structural wall assembly 60. Similarly, cross beams 80 may be connected to the plurality of roof purlin supports 28 and may connect to and/or extend across the roof purlin supports 28.

Figure 20C:
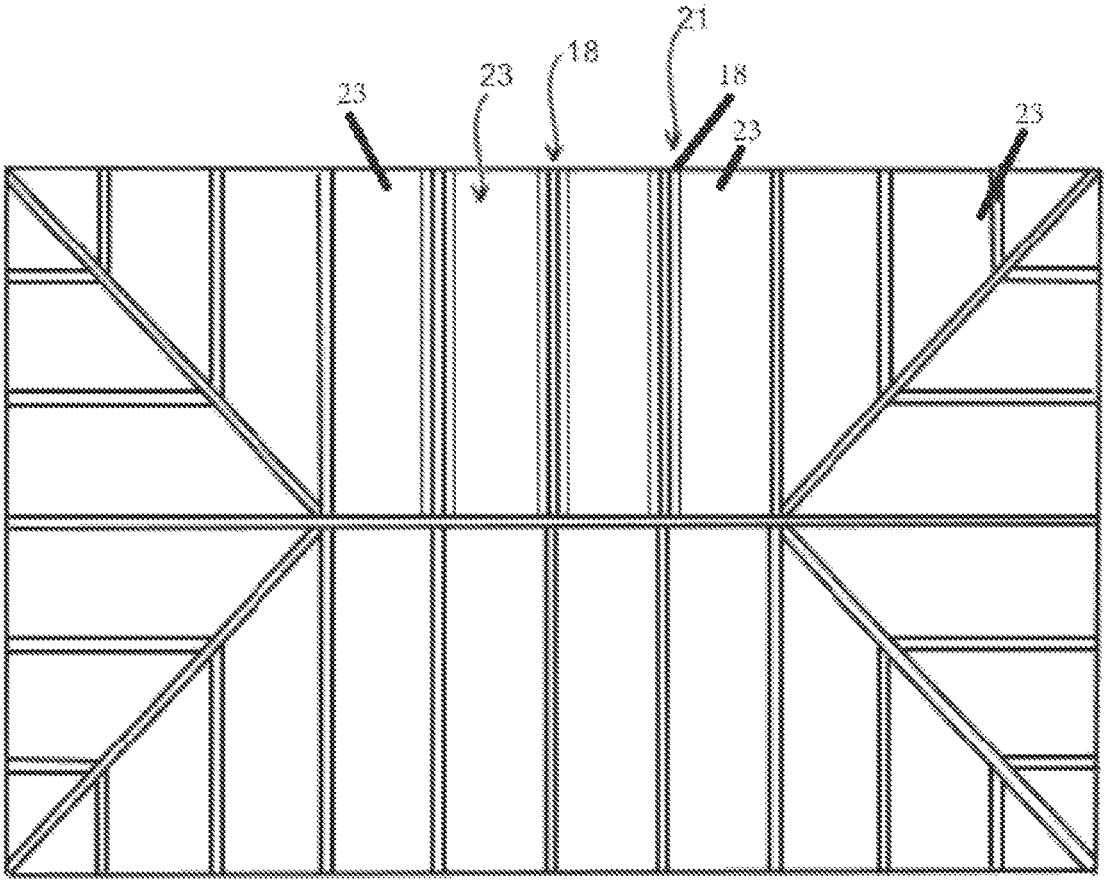
FIG. 20C is a top plan view of an alternative hip roof, formed with U blocks and roof panels according to the present invention.
Figure 20D:
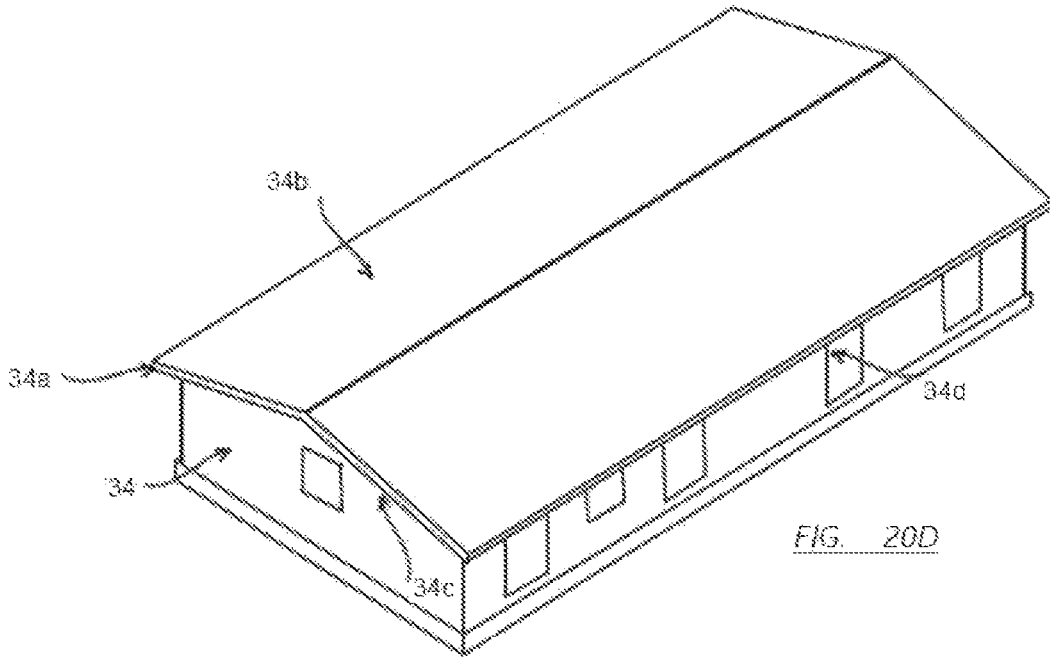
FIG. 20D is a perspective view of a completed monocoque building assembly according to the present invention.

Turning to FIGS. 20A-20D, FIG. 20A shows a side elevational view of a structural schematic of the building assembly, as described in detail previously herein, illustrating the rebar 31 structural support via various U blocks 18, 19 in a wall structure and in the roof. FIG. 20B illustrates one perspective view of the structural schematic of the building assembly. The building assembly 10 includes the skeletal structure of the foundation 32 and the combination of rebar 31 and concrete and/or cementitious material 33 forming columns, headers and sills, and the like, and a roof apex 78 including cross beams 80 which form additional support for the roof support assembly. FIG. 20C shows an alternative roof design, differing from the roof illustrated in FIGS. 20A and 20B. FIG. 20C illustrates a hip roof which includes roof panels 23, some of which are shown connected to U blocks 18 having U block caps 21, each U block 18 including rebar 31 and concrete and/or cementitious material 33 (shown in FIGS. 12C and 13A), which provide structural rigidity. FIG. 20D illustrates a completed building assembly. The building system includes a concrete and/or cementitious material applied to walls 34, roof 34*b*, fascia 34*a*, soffit 34*c*, interiors including walls, and ceilings 34*d*.

Figure 21A:
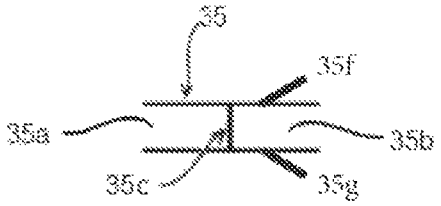
FIG. 21A is a side view of an H connector according to the present invention.
Figure 21B:
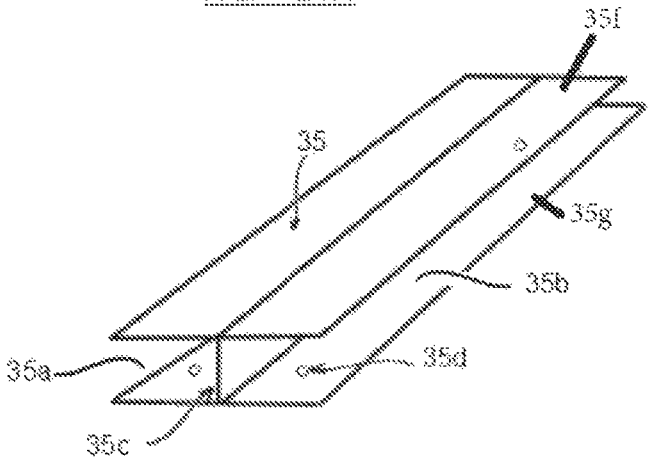
FIG. 21B is a perspective view of the H connector of FIG. 21A.
Figure 21C:
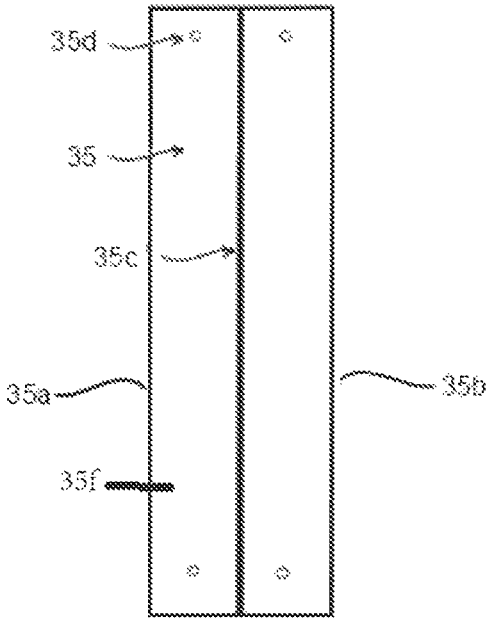
FIG. 21C is a top plan view of the H connector of FIGS. 21A and 21B.

H connectors 35 can be used to connect roof panels 36 together. The H connectors 35 are shown in FIGS. 21A-21C. H connector 35 includes an upper horizontal wall 35*f* and a parallel horizontal lower wall 35*g* which are connected together via vertical rib wall 35*c* positioned therebetween. The H connector 35 includes openings 35*a* and 35*b* located on each side between the vertical rib wall 35*c* and the upper and lower horizontal walls 35*f*, 35*g*, respectively. The H connector 35 also includes a plurality of holes 35*d* in each upper and lower horizontal wall 35*f* and 35*g*, respectively (only one hole designated by the numeral 35*d* in each drawing 21B-21C). The H connectors may be formed from metal(s) such as steel, other metals, alloys, and/or other materials that would operate as shown and described herein.

Figure 22A:
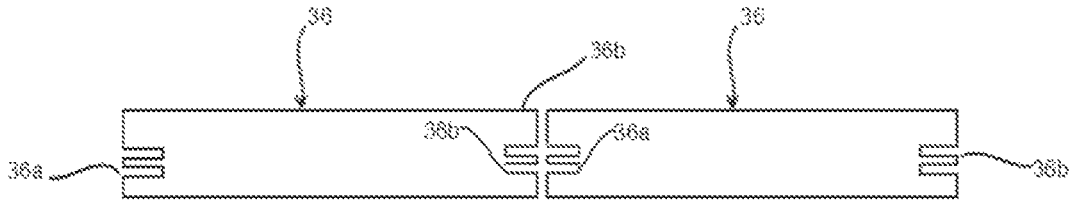
FIG. 22A is a top plan view of roof panels having grooves in opposing edges thereof which are positioned to accept H connectors according to the present invention.
Figure 22B:
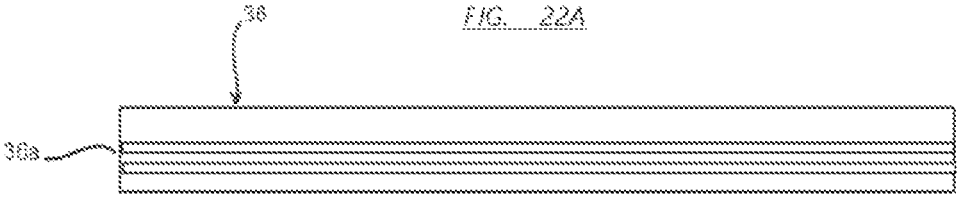
FIG. 22B is a side view of the grooves in a roof panel of FIG. 22A.
Figure 22C:
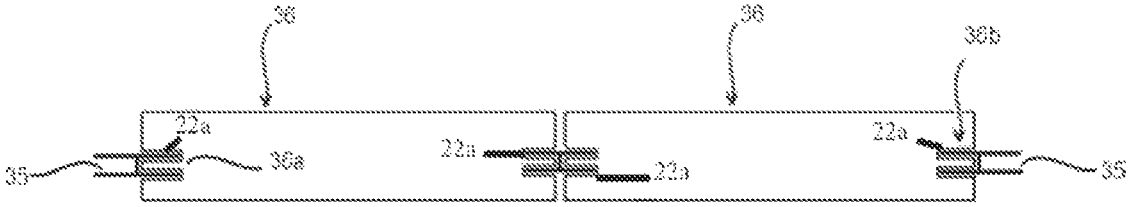
FIG. 22C is a top plan view of the grooved roof panels of FIGS. 22A and 22B connected by H connectors positioned in the grooves.
Figure 22D:
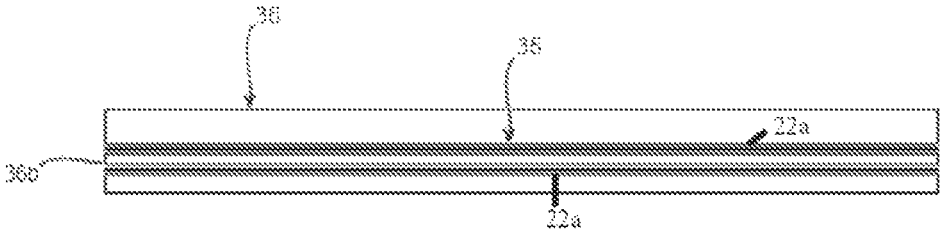
FIG. 22D is a side view of a roof panel similar to FIG. 22C and showing an H connector inserted into the grooves.
Figure 22E:
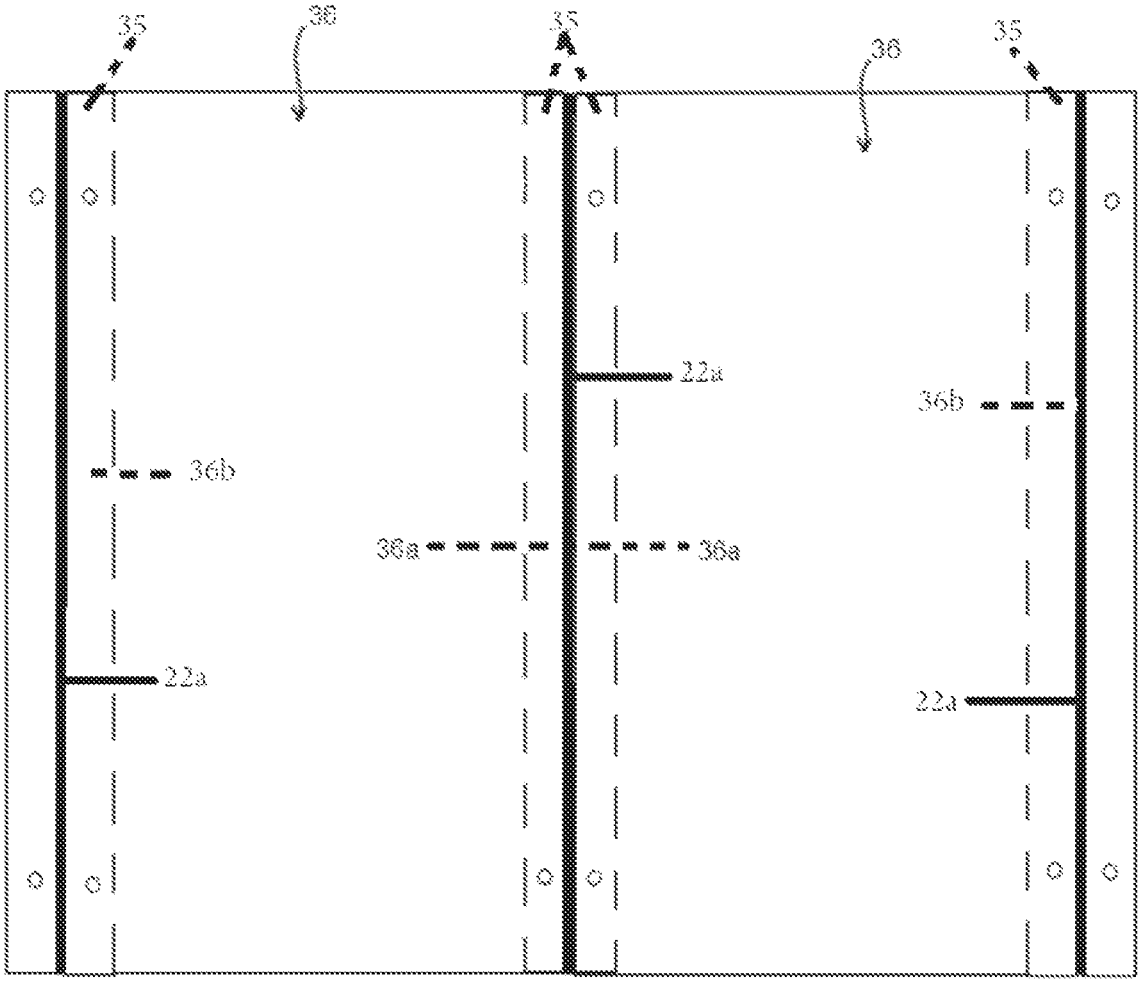
FIG. 22E is a top plan view of the roof panels and H connector similar to FIG. 22C, showing H connectors connecting roof panels, portions of the H connectors indicated by phantom lines.
Figure 27A:
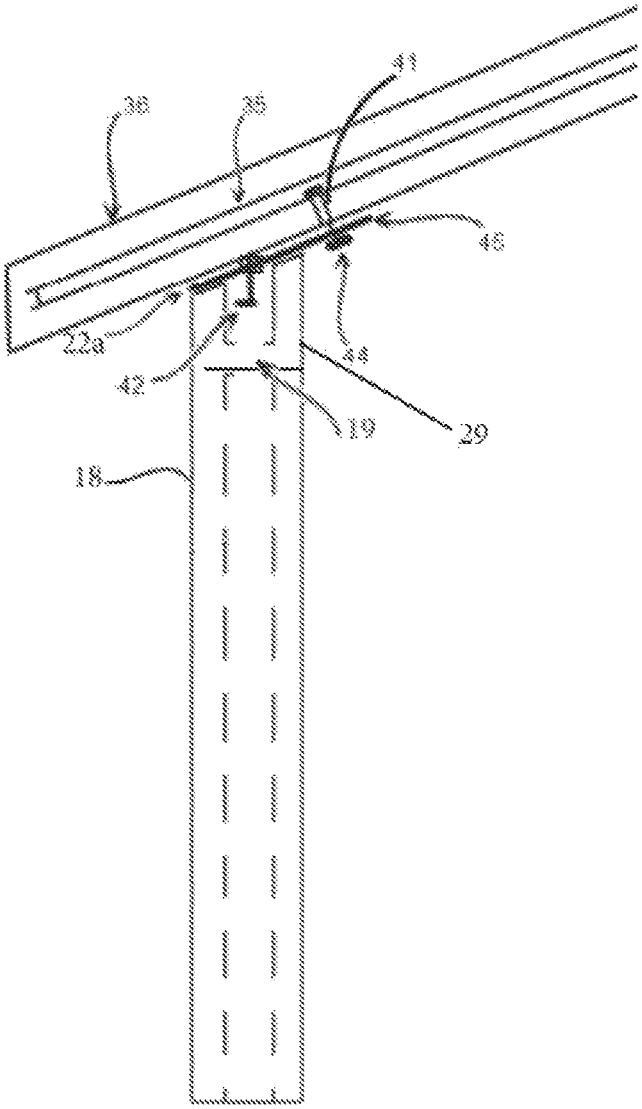
FIG. 27A is a portion of a cross sectional view similar to FIG. 20A, but showing the connection of components between side support walls and roof panels to the present invention.

FIGS. 22A-22E shows roof panels 36. A roof panel 36 with spaced-apart opposing grooved edges 36*a*, 36*b* may be utilized, as illustrated in FIGS. 22A-22B. Roof panels 36 may be connected together via H connectors 35, when H connectors 35 are inserted into roof panel grooves 36*a*, 36*b* and joined together by the adhesive 22*a* positioned in and around the H connectors 35 (shown in FIG. 22C). FIGS. 22C and 22D show two roof panels 36 with grooves 36*a*, 36*b* and H connectors 35 inserted into roof panel grooves 35*a*, 35*b*, thereby connecting both roof panels 36 together. FIG. 22E illustrates roof panels 36 connected by H connectors 35 and the adhesive 22*a*. It will be appreciated that holes 35*d* in H connectors 35 may receive fasteners therethrough (FIG. 27A).

Figure 23A:
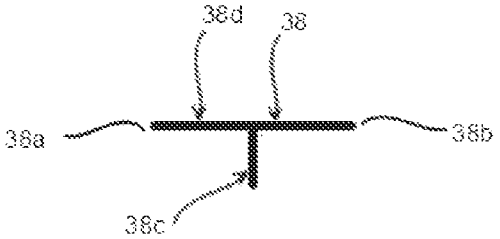
FIG. 23A is a side view of a T connector according to the present invention.
Figure 23B:
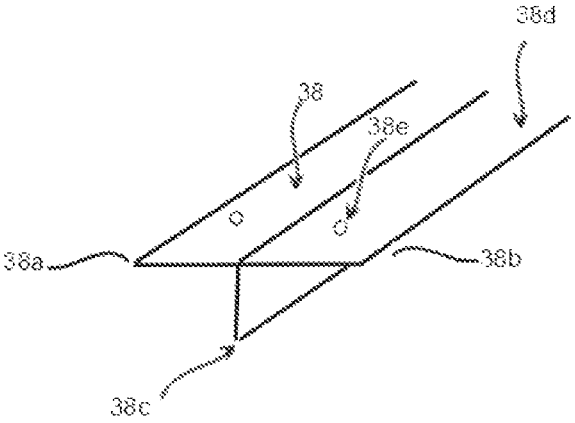
FIG. 23B is a perspective view of the T connector of FIG. 23A.
Figure 23C:
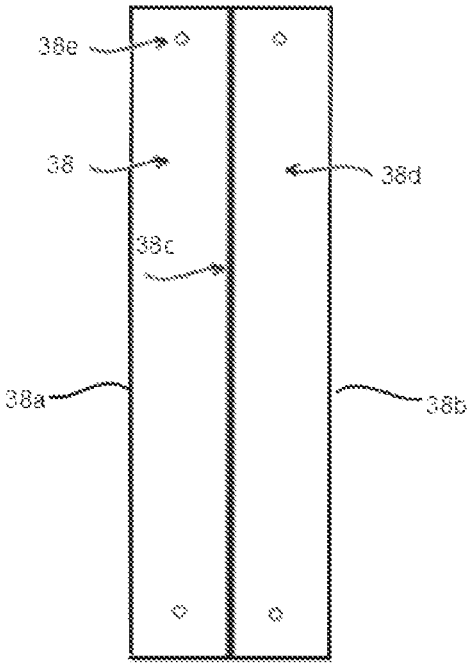
FIG. 23C is a top plan view of the T connector of FIGS. 23A and 23B.

Roof panels can also be connected together by using one or more T connectors 38, as illustrated in FIGS. 23A-23C. A T connector 38 includes a flat top 38*d* including two legs 38*a* and 38*b*, and a center downward extending vertical rib 38*c*. One or more holes (only one hole identified by numeral 38*e*) be formed in legs 38*a* and 38*b*. The T connectors may be formed from metal(s) such as steel, other metals, alloys, and/or other materials that would operate as shown and described herein.

Figure 24A:
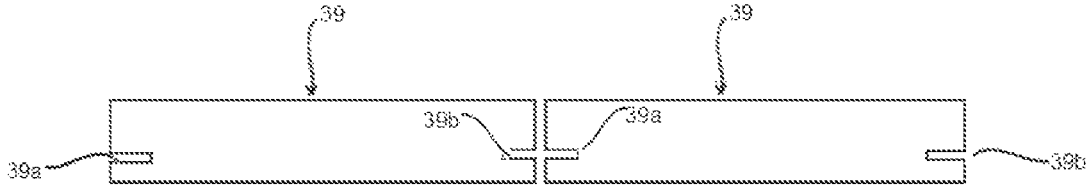
FIG. 24A is a top plan view of roof panels having a groove on each side edge according to the present invention.
Figure 24B:
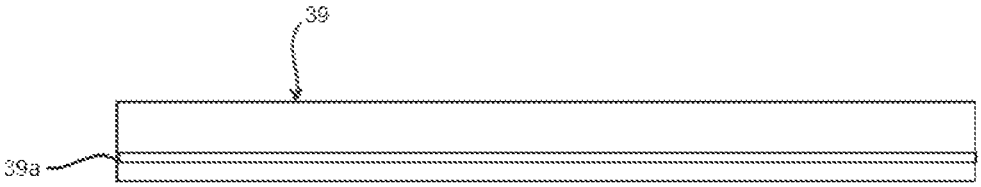
FIG. 24B is a side view of a roof panel of FIG. 24A having a groove therein.
Figure 24C:
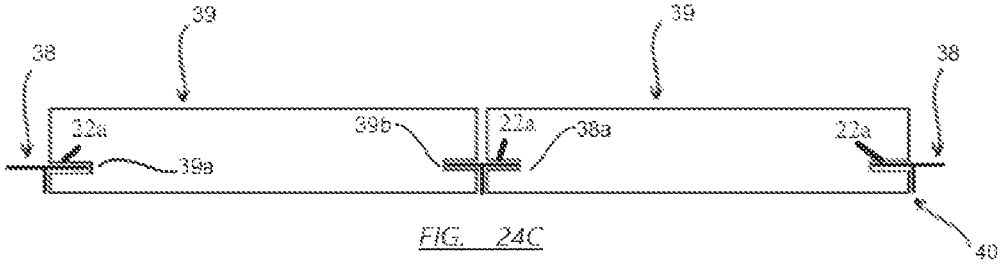
FIG. 24C a top plan view similar to FIG. 24A, but showing a T connector connecting two roof panels together.
Figure 24D:
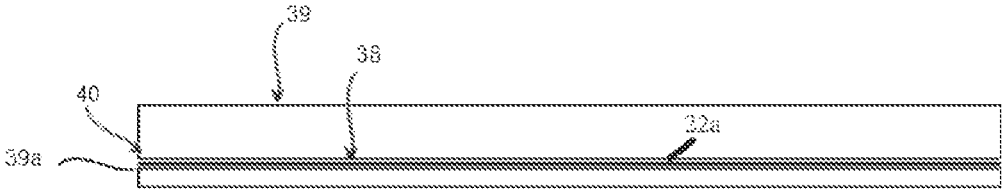
FIG. 24D is a side view of a roof panel of FIG. 24C, showing a T connector positioned in the side groove of the roof panel.
Figure 24E:
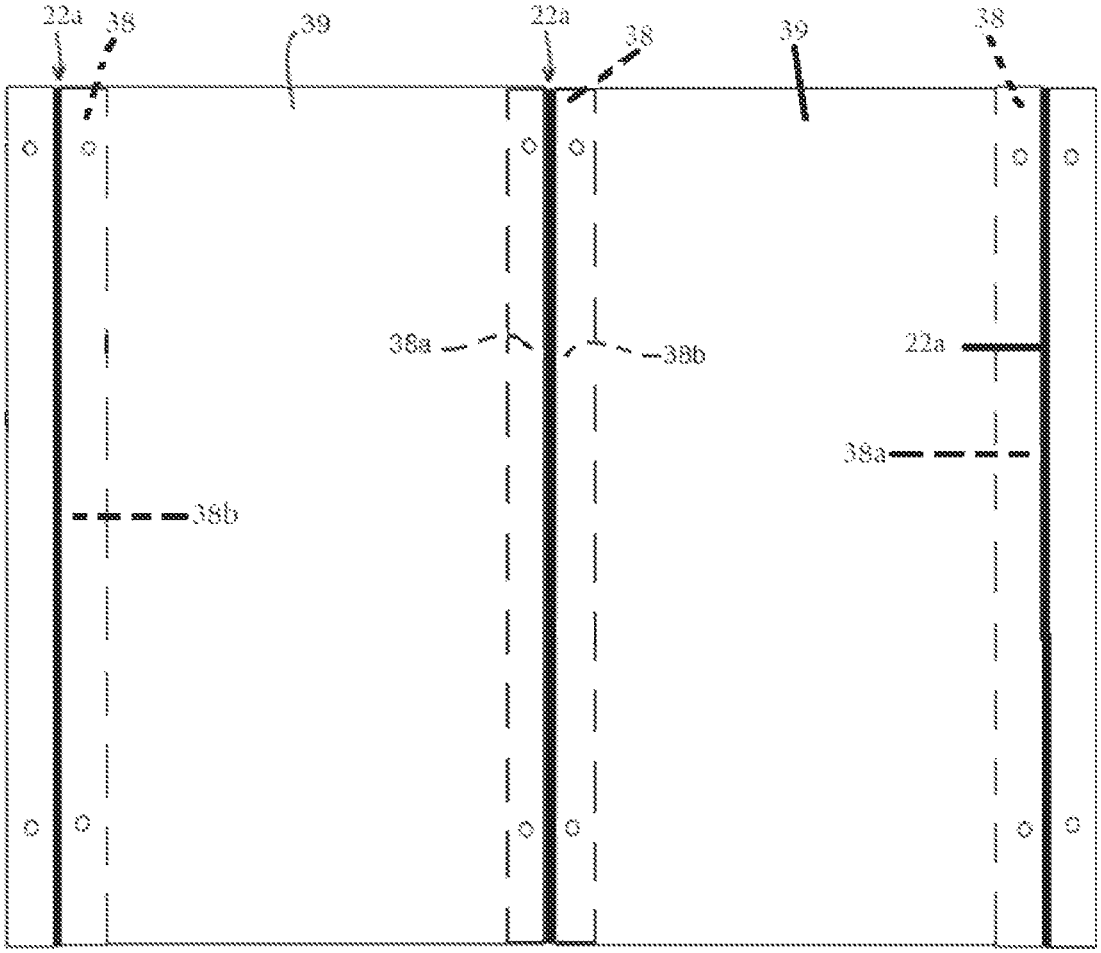
FIG. 24E is a top plan view of the roof panels and T connectors similar to FIG. 24C, showing T connectors connecting two roof panels, portions of the T connectors indicated by phantom lines.

Alternative roof panels 39 are shown in FIGS. 24A-24E, which permit connection therebetween by a T connector 38. FIGS. 24A and 24B illustrate roof panels 39 adapted for use with T connectors 38. Roof panels 39 each include, on opposing edges, grooves 39*a* and 39*b*. For example, FIG. 24B shows a side view of roof panel 39 with groove 39*a*. FIGS. 24C and 24D illustrate roof panels 39 with grooves 39*a*, 39*b* with T connector 38 inserted into grooves 39*a* and 39*b*. An adhesive 22*a* assists in securing the connection of roof panels 39 to each other and the T connector(s) 38 via roof panel grooves 39*a*, 39*b*. FIG. 24E shows roof panels 39 with grooves 39*a*, 39*b* and joined together by T connectors 38 and the adhesive 22*a*. It will be appreciated that holes 39*e* in T connectors 39 will also receive fasteners through coordinated openings in roof panels 39.

Figure 25A:
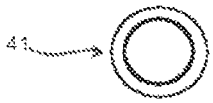
FIG. 25A is an end view of a cylindrical spacer having an opening therethrough according to the present invention.
Figure 25B:
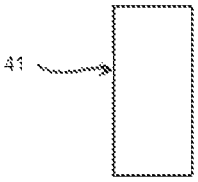
FIG. 25B is a side view of the spacer of FIG. 25A.
Figure 25C:
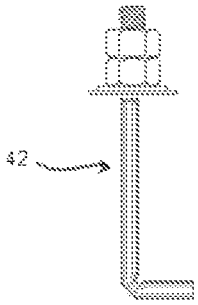
FIG. 25C is a side view of a J bolt with nut and washer according to the present invention.
Figure 25D:
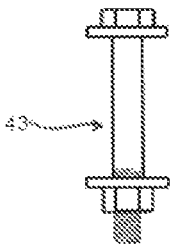
FIG. 25D is a side view of a bolt, washer and nut assembly according to the present invention.
Figure 25E:
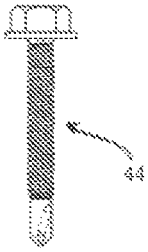
FIG. 25E is a side view of a self tapping screw according to the present invention.

FIGS. 25A-25E illustrates a spacer and various fasteners which may be used in the building assembly. FIGS. 25A-25B illustrate a spacer 41. A J-bolt 42, with nut and washer are shown in FIG. 25C. FIG. 25D illustrates a bolt with a washer and a nut 43. FIG. 25E shows a self-tapping screw 44. The spacer and the various fasteners are commercially available.

Figure 26A:
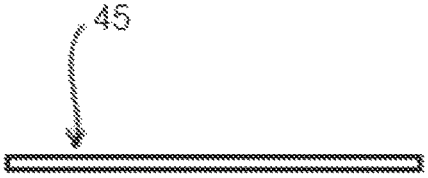
FIG. 26A is a side view of a connector plate according to the present invention.
Figure 26B:
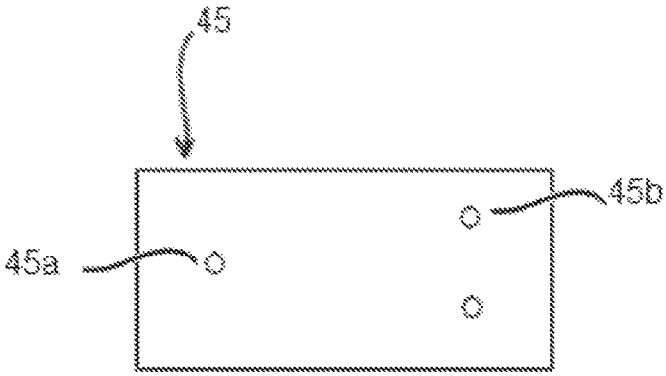
FIG. 26B is a top plan view the connector plate of FIG. 26A.

FIGS. 26A-26B illustrates a connection plate 45. The connection plate 45 may include a plurality of holes, such as, for example, but not by way of limitation, holes 45*a* and 45*b*, and may facilitate, via fasteners. A connection between the roof panels and a portion of the wall structure assembly, such as an H block, as shown in FIG. 27A.

FIG. 27A illustrates a roof panel and wall panel assembly connection which includes a U block 19 (or wall beam 29) and a connector plate 45 attached to the top of the horizontal U-block 19 (U block 18 and U block 19 having rebar and concrete and/or cementitious material, as shown in FIG. 13A), with J-bolt 42 positioned in a portion of the concrete and/or cementation material and the connector plate 45. An H connector 35 is schematically shown inserted into the roof panel 36, and the spacer 41 is inserted into the roof panel 36, while the self-tapping screw 44 is positioned through the spacer to attach the H connector 35 to the connection plate 45. The adhesive 22*a* also bonds the roof panel 36 to the horizontal U block 19/wall beam 29.

Figure 28A:
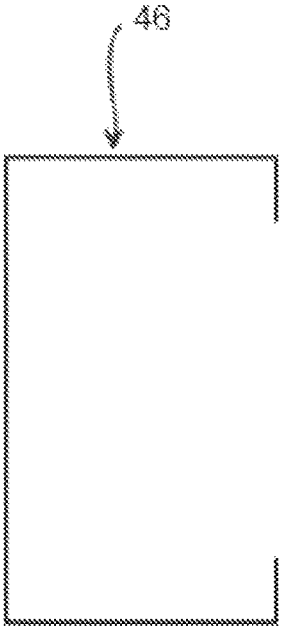
FIG. 28A is a side view of a roof purlin support bracket according to the present invention.
Figure 28B:
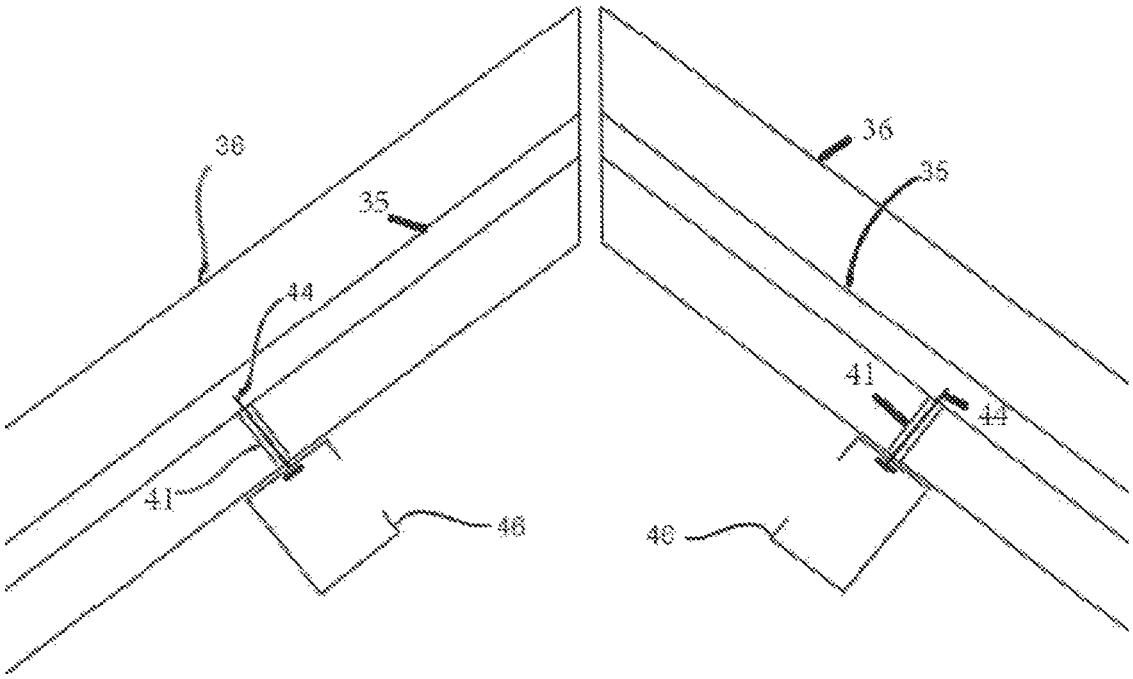
FIG. 28B is a side view of the roof purlin support bracket of FIG. 28A connected to a portion of the roof assembly.

FIG. 28A shows a side view of an alternative roof purlin support bracket 46. FIG. 28B shows a roof connection of the alternative roof purlin support bracket 46, which includes roof panel 36, H connectors 35, and spacers 41 and self-tapping screw 44 inserted into the alternative roof purlin support bracket 46 and extending to and connecting to the roof panel 36 and the H connector 35. An adhesive 22*a* may also be used to bond the roof panels 36 together, as shown and described previously herein. It will also be understood that in constructing a roof of a building, temporary shoring may be used on the inside and/or the outside of the building assembly (not shown).

Figure 29A:
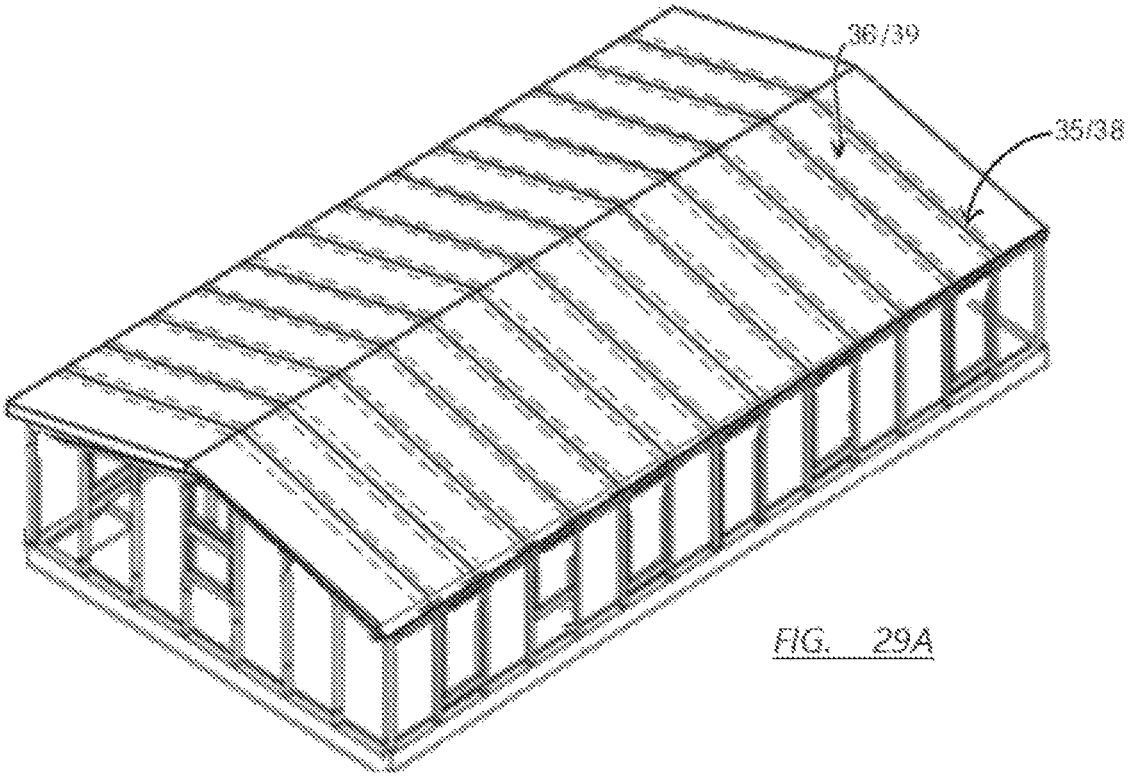
FIG. 29A is a perspective view of a building assembly showing roof panels, which can be connected by U blocks, H connectors, and/or T connectors to a roof structure according to the present invention.
Figure 29B:
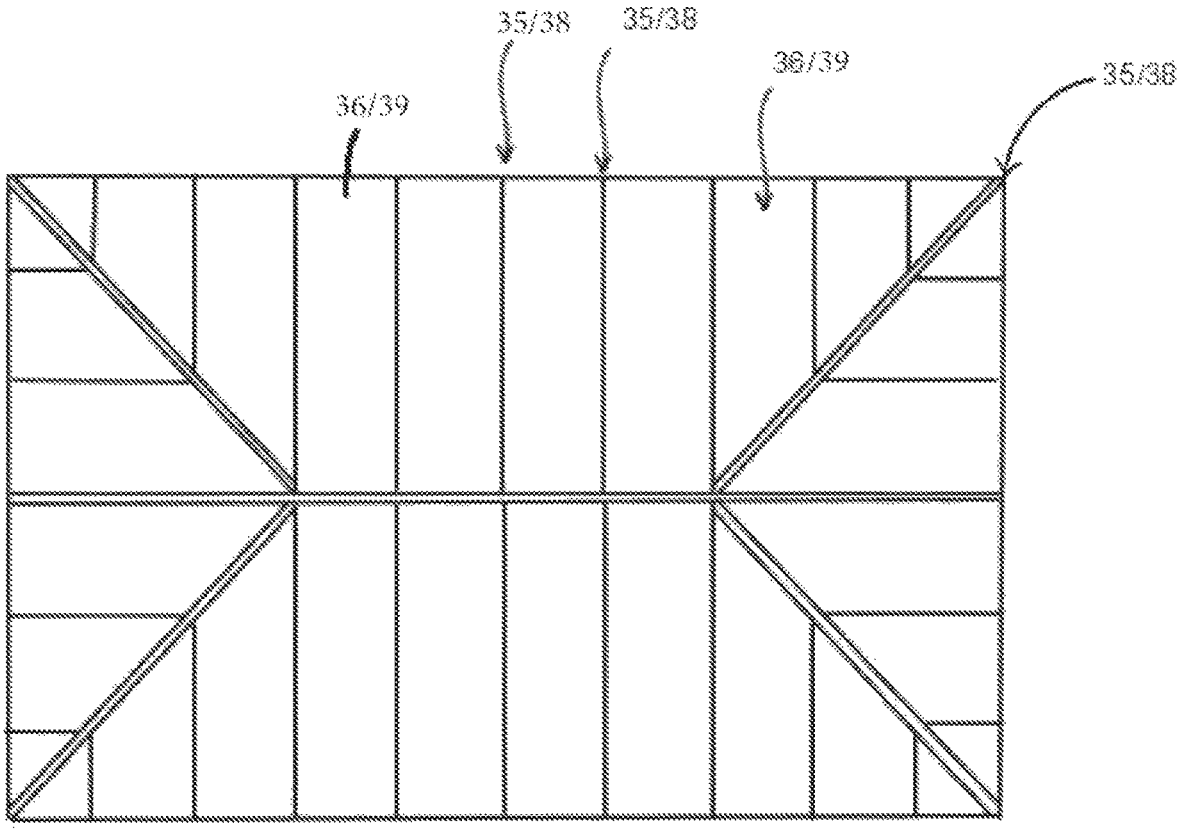
FIG. 29B is a top plan view of a hip roof formed from roof panels which uses roof panels with H connectors and/or T connectors according to the present invention.
Figure 29C:
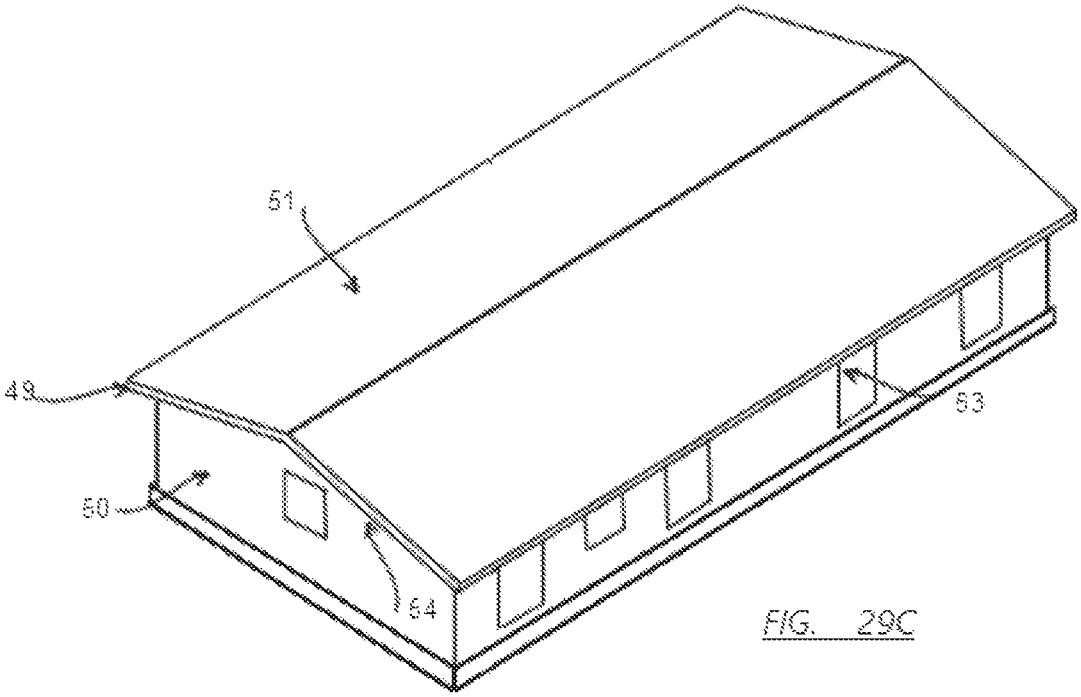
FIG. 29C is a perspective view of a monocoque building assembly according to the present invention.

FIG. 29A-29C illustrates various views of the building assembly. The building assembly of FIG. 29A includes a plurality of H connectors 35 and/or T connectors 38 connecting roof panels 36 and 39, respectively. FIG. 29B shows a hip roof configuration which may also include a plurality of H connectors 35 and T connectors 38 that are inserted into roof panels 36, 39, respectively. FIG. 29C shows a building assembly having a cementitious material applied to all surfaces, including, for example, but not by way of limitation, walls 50, soffits 54, fascia 49, roof 51, and interior ceilings and partition walls 53. Once completed, as illustrated in FIG. 29C, the entire inner and outer surface area of the building will be encapsulated with a cementitious material that bonds to the surfaces and enhances the building's impact resistance, rigidity, water resistance, fire resistance, mold and mildew resistance, insect infestation resistance, and strength.

The building assembly once erected and surface coated with a cementitious material can be clad with a myriad of standard building materials such as roofing membranes, roofing tiles, roofing shingles, MGO boards, plywood, paints, coatings and other waterproofing membranes to offer additional water resistance, and resistance to fire, mold and mildew, and insect infestation to the roof. A number of standard building materials such as brick, siding, paints, coatings, stuccos and stone can be used, that when applied or attached to the walls, can provide the building assembly with additional waterproofing, fire resistance and aesthetics. It will be understood that a myriad of standard building materials may be applied or attached to the interior walls and ceilings as well.

Wall panels using U blocks, U block caps, sills, and headers, to form walls makes forming walls quick and simple. Roof panels using U blocks, grooved panels with H connectors and/or T connectors makes joining roof panels rapid and easy. Preformed voids, or alternatively, creating grooves and chases in the building assembly makes is simple to insert utility apparatuses therein, such as, for example but not by way of limitations, electrical wiring, plumbing, internet, HVAC, and the like. Attaching window frames, door frames, shutters, security bars, backing and bucking to the concrete filled voids and recesses within the building assembly as well as the faces within the building assembly is quick and easy.

Surface coating the entire surface area (outer and inner) of the building assembly with a cementitious material enhances the longevity, energy efficiency, rigidity, impact resistance, water resistance, wind resistance, fire resistance, insect infestation resistance, and mold and mildew resistance of the building assembly, and is quickly and simply accomplished. It will be appreciated that adhering, attaching or applying paints, membranes, roof tiles, brick, stone, or other standard building materials to the coated surfaces of the building assembly will enhance the building assembly's useful life and aesthetic appearance. Most importantly, the present building assembly provides low cost and rapidly erected housing to areas of the world where such building assemblies are needed.

The present invention has been shown and described herein in what is considered to be the most practical and preferred embodiments. However, it is recognized that departures therefrom and modifications will often remain within the scope of the invention.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A building assembly for constructing a building, comprising:

a foundation including rebar positioned in preselected areas of the foundation and which extends above the foundation in preselected areas;

a plurality of building components, including a plurality of wall panels preformed from expanded polystyrene;

a plurality of sill panels preformed from expanded polystyrene;

a plurality of header panels preformed from expanded polystyrene;

a plurality of U blocks preformed from expanded polystyrene, wherein each U block of the plurality of U blocks includes a recess preformed therein and extending therethrough, the plurality of U blocks defined by a first portion of U blocks, a second portion of U blocks, and a third portion of U blocks; and a preformed U block cap configured to be positioned over the recess of each U block of the first portion and each U block of the third portion to cover the recess, the preformed U block cap connected to each U block via an adhesive to form a void extending therethrough;

a plurality of wall structures formed from a plurality of preselected formations connected together via the adhesive, wherein each pre-selected formation includes at least one preformed U block from the plurality of U blocks of the first portion, and at least one other building component of the plurality of building components selected from the group consisting of a) one preformed wall panel of the plurality of wall panels, b) one preformed sill panel of the plurality of sill panels, and c) one preformed header from the plurality of headers, to form each preselected formation, wherein each U block of the second portion is positioned in at least one of a horizontal position and an angled position on an upper surface of each preselected formation to form each wall structure of the plurality of wall structures, each U block of the second portion positioned with the recess therein positioned on an upper surface thereof, each U block of the second portion connected to each preselected formation via the adhesive, wherein a plurality of openings are formed in the recess of each U block of the second portion, and a perimeter of each opening is axially aligned with a perimeter of the recess of each U block of the first portion in each wall structure, respectively;

wherein each U block of the first portion of the plurality of U blocks includes rebar in the recess therein, and when each wall structure is positioned vertically on the foundation, the rebar in each U block of the first portion connected to the rebar extending from the preselected locations of the foundation, and each U block of the second portion of the plurality of U blocks having rebar in the recess therein, and the rebar in each U block of the first portion extends upward and connects to rebar in the second portion, and the rebar in each U block of the first portion connects to rebar positioned in each recess of each U block of a third portion of the plurality of U blocks on a roof structure constructed over at least a pair of wall structures, wherein one U block cap is positioned over the recess of each U block of the first portion and adhesively connected to the U block of the first portion to form the void therein after rebar is inserted therein, and wherein at least one of concrete and cementitious material is positioned in the recess of each U block of the second portion and flows through the plurality of openings therein to the void of each capped U block of the first portion, such that the rebar and the at least one of concrete and cementitious material in each capped U block of the first portion forms a solid structural vertical column, and the rebar and the at least one of concrete and cementitious material in the recess of each U block of the second portion forms a wall bond beam for structural support;

a preformed window perimeter structure included in at least one wall structure which includes the sill panel and the header panel, the sill panel and the header panel positioned spaced apart between a pair of capped U blocks of the first portion of the plurality of U blocks to form the perimeter for a window opening configured to receive a window frame and a window, wherein each capped U block of the pair of capped U blocks of the first portion includes the void with rebar and the least one of concrete and cementitious material positioned therein, each capped U block including a plurality of recesses positioned on a side of each capped U block, the plurality of recesses connected to the void and including the at least one of concrete and cementitious material therein;

a preformed outer door perimeter included in at least one wall structure which includes a header panel positioned between a pair of capped U blocks of the first portion of the plurality of U blocks to form the perimeter for a door opening configured to receive a door frame and a door, wherein and each capped U block of the pair of capped U blocks of the first portion includes the void with rebar and the least one of concrete and cementitious material positioned therein, each capped U block including a plurality of recesses positioned on a side of each capped U block, the plurality of recesses connected to the void and including the at least one of concrete and cementitious material therein;

the roof structure, including at least one pair of opposing end wall structures, each end wall structure of the at least one pair including at least one end wall beam positioned above and connected via the adhesive to each of the pair of opposing end wall structures, the at least one end wall beam formed from one or more U blocks of the second portion, each U block having rebar and the at least one of concrete and cementitious material positioned in the recess therein, a roof apex beam extending between an apex of each end wall structure of the pair of end wall structures, a plurality of support brackets connected to the roof apex beam and to at least one wall bond beam, the plurality of support brackets positioned spaced-apart and opposite relative to each other on the roof apex beam and the at least one wall bond beam, respectively, to form a plurality of pairs of opposing support brackets, each opposing pair of support brackets carrying a support;

a plurality of preformed roof panels formed from an expanded polystyrene, each roof panel of the plurality of roof panels connected to at least one of a) each other via the adhesive, b) at least one U block of the third portion of the plurality of U blocks, and c) at least one connector, wherein each roof panel is carried by at least one support of the roof structure and forms a roof panel structure when connected to at least one of a) a plurality of roof panels connected to each other and connectable to the roof structure, b) a U block of the third portion connectable to the roof structure, and c) at least one connector connectable to the roof structure; and wherein when each U block of the third portion of the plurality of U blocks is included in the roof panel structure, the recess in each U block of the third portion includes rebar and is configured to hold the at least one of concrete and cementitious material, the rebar in each U block of the third portion extending outward to connect to at least a portion of the roof structure, wherein each U block of the third portion has one preformed U block cap which is connected via the adhesive to cover the recess thereof in order to hold the at least one of concrete and cementitious material therein.

2. The building assembly of claim 1, wherein in the pair of capped U blocks of the first portion having the plurality of recesses forming a part of each preformed sill perimeter and each preformed door perimeter, the at least one of concrete and cementitious material within the plurality of recesses provides rigidity and reinforcement to each preformed sill perimeter and each preformed door perimeter.

3. The building assembly of claim 2, wherein the plurality of recesses in the side of each capped U block are spaced-apart and perpendicular relative to the void in each capped U block.

4. The building assembly of claim 1, wherein at least a portion of the plurality of roof panels includes a pair of grooves formed in side edges thereof and each roof panel interconnects with at least one other roof panel via an H connector which includes a plurality of legs which insert into the pair of grooves in each roof panel, wherein each H connector includes at last one hole to permit coupling of the H connector to at least one of a) the roof panel and b) the roof structure.

5. The building assembly of claim 1, wherein at least a portion of the plurality of preformed roof panels includes a groove formed in each side edge thereof and each roof panel interconnects with another roof panel via a T connector which includes a pair of legs, each leg which inserts into the groove in each roof panel, wherein each T connector includes at least one hole to permit coupling of the T connector to at least one of a) the roof panel and b) the roof structure.

6. The building assembly of claim 5, wherein the cementitious material forms a monocoque structure which encompasses the building assembly, and the building formed by the building assembly is rated to withstand hurricane force winds and the monocoque structure is resistant to earthquakes.

7. The building assembly of claim 1, further comprising a cementitious material which is applied to the building constructed from the building assembly to encompass all surfaces of all inside structures and all outside structures of the building in the cementitious material, wherein the cementitious material has a thickness in a range from one-eighth inch thickness to one inch thickness.

8. The building assembly of claim 1, comprising a preformed interior partition wall structure formed from a portion of the plurality of wall panels.

9. The building assembly of claim 8, wherein the preformed interior partition wall structure includes an inner door perimeter which is formed from at least one wall panel and a header panel.

10. The building assembly of claim 1, wherein each U block having a U block cap has one of a square inner perimeter defining the void therein and a rectangular inner perimeter defining the void therein.

11. A method of using a building assembly to construct a building, the method comprising:

providing a foundation having rebar positioned in preselected areas therein and extending therefrom;

providing a plurality of building components, including a plurality of preformed wall panels formed from expanded polystyrene;

a plurality of sill panels formed from expanded polystyrene;

a plurality of header panels formed from expanded polystyrene;

a plurality of U blocks preformed from expanded polystyrene, wherein each U block of the plurality of U blocks includes a recess preformed therein and extending therethrough, the plurality of U blocks defined by a first portion of U blocks, a second portion of U blocks, and a third portion of U blocks; and a preformed U block cap configured to be positioned over the recess of each U block of the first portion and each U block of the third portion to cover the recess, the preformed U block cap connected to each U block via an adhesive to form a void extending therethrough;

forming a plurality of wall structures from a plurality of preselected formations, each of the preselected formations constructed by selecting at least one preformed U block of the first portion of the plurality of U blocks and at least one other building component of the plurality of building components selected from the group consisting of a) one preformed wall panel of the plurality of wall panels, b) one preformed sill panel of the plurality of sill panels, c) one preformed header panel of the plurality of header panels, and connecting the selected building components together via the adhesive to form each preselected formation, and connecting each U block of the second portion of the plurality of U blocks to an upper surface of each preselected formation via an adhesive, each U block of the second portion positioned in at least one of a horizontal position and an angled position, to form each wall structure, wherein a plurality of openings are formed in the recess of each U block of the second portion, and a perimeter of each opening is aligned with a perimeter of the recess of each U block of the first portion;

positioning rebar in each U block of the first portion of the plurality of U blocks;

positioning rebar in each U block of the second portion of the plurality of U blocks;

connecting the rebar in one end of each U block of the first portion with rebar in preselected areas of the foundation, and connecting rebar in an opposite end of each U block of the first portion to rebar in each U block of the second portion, the rebar of each U block of the first portion configured to connect to rebar in each U block of the third portion of the plurality of U blocks;

positioning one U block cap over the recess of each U block of the first portion of the plurality of U blocks by connecting the U block cap via the adhesive to each U block of the first portion, forming a plurality of capped U blocks of the first portion;

providing a preformed window perimeter included in one wall structure of the plurality of wall structures which includes a sill panel spaced apart from a header panel and positioning both the sill panel and the header panel between a pair of capped U blocks of the first portion to form a perimeter for a window opening configured to receive a window frame and a window, wherein each capped U block of the pair of capped U blocks includes the void with rebar therein as well as a plurality of recesses on a side of each capped U block of the pair of capped U blocks forming a portion of the perimeter, the plurality of recesses on the side connecting to the void in each capped U block and configured to receive at least one of concrete and cementitious material therein;

providing a preformed outer door perimeter included in one wall structure of the plurality of wall structures which includes a header panel positioned between a pair of capped U blocks of the first portion of the plurality of U blocks to form the perimeter for an outer door opening configured to receive an outer door frame and an outer door, wherein each capped U block of the pair of capped U blocks of the first portion includes a void therein as well as a plurality of recesses on a side of each capped U block of the pair of capped U blocks forming a portion of the perimeter, the plurality of recesses on the side connecting to the void in each capped U block and configured to receive the at least a portion of the at least one of concrete and cementitious material therein;

providing the roof structure, including at least one pair of opposing end wall structures, each end wall structure including at least one end wall beam which is positioned above and connected via the adhesive to at least one wall structure of the plurality of wall structures, the at least one end wall beam formed from one or more U blocks having rebar and the at least one of concrete or a cementitious material positioned in the recess therein, a roof apex beam extending from an apex of each end wall structure;

providing a plurality of support brackets connected to at least one of the roof apex beam and at least one wall bond beam, connecting the plurality of support brackets in opposing pairs on the roof apex beam and the at least one wall bond beam, respectively;

providing a plurality of roof supports and positioning the plurality of roof supports, such that each opposing pair of support brackets carries one roof support of the plurality of roof supports;

providing a plurality of roof panels formed from expanded polystyrene, each roof panel of the plurality of roof panels connected to at least one of a) each other via the adhesive, b) one U block of the third portion, and c) at least one connector, wherein each roof panel is carried by at least one support of the roof structure and forms a plurality of roof panel structures when connected to at least one of a) a plurality of roof panels connect to each other and connectable to the roof structure, b) at least one U block of the third portion connectable to the roof structure, and c) at least one connector carrying a roof panel connectable to the roof structure;

providing rebar to each U block of the third portion of the plurality of U blocks and connecting rebar extending from each U block of the first portion to one end of the rebar in each U block of the third portion, and connecting an opposite end of the rebar in the third portion to rebar in the roof structure;

pouring the at least one of the of the concrete and cementitious material into the recess of each U block of the third portion, and connecting one U block cap via adhesive to each U block of the third portion to close the recess and to form a void having rebar and the one of concrete and cementitious material; and simultaneously pouring the at least one of concrete and cementitious material into the recess of the second portion of the U blocks of the plurality of U blocks such that the at least one of concrete and cementitious material flows through and fills the recesses in each U block of the second portion, the at least one of the concrete and cementitious material flowing through the plurality of openings formed in each recess of each U block of the second portion and into each void of each capped U block of the first portion to fill each void thereof, each U block of the first portion forming a structural vertical column, each U block of the second portion forming a structural wall bond beam, and each U block of the third portion forming a structural beam of the roof structure.

12. The method of claim 11, wherein in the steps of providing a preformed sill perimeter, and providing a preformed door perimeter, the at least one of concrete and cementitious material is positioned in the void of each capped U block of the pair of capped U blocks of the first portion and into the plurality of recesses to fill the recesses to provide rigidity and reinforcement to each preformed sill perimeter and each preformed door perimeter.

13. The method of claim 12, wherein the plurality of recesses in the side of each capped U block of the first portion are spaced-apart and perpendicular relative to the void in each capped U block.

14. The method of claim 11, wherein in the step of providing a plurality of roof panels, at least a portion of the plurality of roof panels includes a pair of grooves formed in side edges thereof and each roof panel interconnects with at least one other roof panel via an H connector which includes a plurality of legs which insert into the pair of grooves in each roof panel, wherein each H connector includes at least one hole to permit coupling of the H connector to at least one of a) the roof panel and b) the roof structure.

15. The method of claim 11, wherein in the step of providing a plurality of roof panels, at least a portion of the plurality of roof panels includes a groove formed in each side edge thereof and each roof panel interconnects with another roof panel via a T connector which includes a pair of legs, each leg which inserts into the groove in each roof panel, wherein each T connector include at least one hole to permit coupling of the T connector to at least one of a) the roof panel and b) the roof structure.

16. The method of claim 11, further comprising the step of applying the cementitious material to a building constructed from the building assembly to encompass all surfaces of all inside structures and all outside structures of the building in the cementitious material, wherein the cementitious material has a thickness in a range from one-eighth (1/8) inch thickness to one (1) inch thickness.

17. The method of claim 16, wherein the cementitious material forms a monocoque structure which encompasses the building assembly, and the building formed by the building assembly is rated to withstand hurricane force winds and is resistant to earthquakes.

18. The method of claim 11, further comprising the step of providing a preformed interior partition wall structure formed from a portion of the plurality of preformed wall panels, each wall panel of the plurality of walls panels connected to each other via the adhesive.

19. The method of claim 18, wherein the preformed interior partition wall structure includes an inner door perimeter which is formed from at least one wall panel and a header panel.

20. The method of claim 11, wherein in the step of providing a plurality of U blocks, each U block having a U block cap has one of a square inner perimeter defining the void therein and a rectangular inner perimeter defining the void therein.

* * * * *